US011158265B2

(12) United States Patent
Seo et al.

(10) Patent No.: US 11,158,265 B2
(45) Date of Patent: Oct. 26, 2021

(54) SCAN DRIVER AND DISPLAY DEVICE INCLUDING THE SAME

(71) Applicant: Samsung Display Co., Ltd., Yongin-si (KR)

(72) Inventors: Hae Kwan Seo, Yongin-si (KR); Jae Woo Ryu, Yongin-si (KR); Myung Ho Lee, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/115,034

(22) Filed: Dec. 8, 2020

(65) Prior Publication Data

US 2021/0256912 A1 Aug. 19, 2021

(30) Foreign Application Priority Data

Feb. 14, 2020 (KR) ..... 10-2020-0018179

(51) Int. Cl.
*G09G 3/3266* (2016.01)
*G09G 3/3275* (2016.01)
*G09G 3/3233* (2016.01)

(52) U.S. Cl.
CPC ..... *G09G 3/3266* (2013.01); *G09G 3/3275* (2013.01); *G09G 3/3233* (2013.01); *G09G 2310/0283* (2013.01); *G09G 2310/08* (2013.01); *G09G 2320/0233* (2013.01); *G09G 2320/0252* (2013.01); *G09G 2330/021* (2013.01)

(58) Field of Classification Search
CPC ..... G09G 3/3266; G09G 3/3275; G09G 2330/021; G09G 2320/0252; G09G 2320/0233; G09G 3/3233; G09G 2310/08; G09G 2310/0283
See application file for complete search history.

(56) References Cited

U.S. PATENT DOCUMENTS

2016/0274713 A1* 9/2016 Zhang ..... G11C 19/28
2017/0287425 A1* 10/2017 Koo ..... G09G 3/3674
2020/0356203 A1* 11/2020 Wang ..... G06F 3/0412
2021/0027697 A1 1/2021 Yoon et al.
2021/0035489 A1 2/2021 Seo et al.

FOREIGN PATENT DOCUMENTS

KR 10-0637227 B1 10/2006
KR 10-2016-0056234 A 5/2016
KR 10-2017-0010223 A 1/2017
KR 10-1761414 B1 7/2017
KR 10-2018-0078436 A 7/2018
KR 10-2021-0013505 A 2/2021
KR 10-2021-0014258 A 2/2021

* cited by examiner

*Primary Examiner* — Christopher J Kohlman
(74) *Attorney, Agent, or Firm* — Lewis Roca Rothgerber Christie LLP

(57) ABSTRACT

In a scan driver and a display device including the same, a first input terminal of a stage receives a scan start signal or an output signal of a previous stage when a first control signal is supplied, a second input terminal of the stage receives one of two clock signals, a third input terminal of the stage receives the other of the two clock signals, and a fourth input terminal of the stage receives a scan start signal or an output signal of a next stage when a second control signal is supplied, and a first power source is outputted from an output terminal of the stage when a first clock signal and a second clock signal are low levels.

20 Claims, 11 Drawing Sheets

SCAN DRIVER AND DISPLAY DEVICE INCLUDING THE SAME

CROSS-REFERENCE TO RELATED APPLICATION

The present application claims priority to and the benefit of Korean Patent Application No. 10-2020-0018179, filed in the Korean Intellectual Property Office on Feb. 14, 2020, the entire content of which is incorporated herein by reference.

BACKGROUND

1. Field

Aspects of some example embodiments of the present invention relate to a scan driver and a display device including the same.

2. Discussion of the Related Art

Flat-panel display devices, which may have a relatively reduced weight and volume compared to alternative display devices, such as cathode ray tube displays, include liquid crystal displays, field emission displays, plasma display panels, and organic light emitting display devices.

Organic light emitting display devices display images by using an organic light emitting diode that generates light by recombination of electrons and holes. The organic light emitting display device may have a relatively fast response speed and may be driven with relatively low power consumption.

A display device may include a data driver for supplying data signals to data lines, a scan driver for sequentially supplying scan signals to scan lines, and a display part including a plurality of pixels connected to the scan lines and the data lines.

A pixel may be selected when the scan signal is supplied to the scan line, and receives the data signal from the data line. In addition, the pixel displays an image while generating light having a luminance (e.g., a predetermined luminance) corresponding to the data signal.

Meanwhile, display devices may have a problem in that an image having a desired luminance may not be displayed due to deterioration of a light emitting diode that occurs over time. Accordingly, an image having a uniform luminance may be displayed by compensating for characteristics such as a threshold voltage and mobility of a driving transistor comprised in each of the pixels.

Even in this case, the scan signals are sequentially supplied to the scan lines to select a specific pixel, and a sensing operation is terminated after the scan signal is supplied up to a last scan line of one frame even after a specific pixel is selected, thus there is a problem in that power consumption is unnecessarily consumed, and an unnecessary time is required in addition to a sensing period.

The above information disclosed in this Background section is only for enhancement of understanding of the background and therefore the information discussed in this Background section does not necessarily constitute prior art.

SUMMARY

Aspects of some example embodiments of the present disclosure include a scan driver and a display device that may reduce a time required for sensing by masking clock signals after a sensing period.

In addition, example embodiments according to the present disclosure may include a scan driver and a display that may reduce power consumption by preventing or reducing instances of scan signals being unnecessarily supplied to each of scan lines after a scan line corresponding to a pixel row to be sensed.

The characteristics of embodiments according to the the present invention are not limited to the characteristics mentioned above, and other technical characteristics that are not mentioned may be more clearly understood to a person of an ordinary skill in the art using the following description.

Aspects of some example embodiments of the present disclosure include a scan driver including: a plurality of stages, wherein each of the stages may comprise an input part configured to control voltage of a first node in response to signals of a first input terminal, a second input terminal, and a third input terminal; a driving part configured to control a voltage of the second node in response to voltages of the second input terminal and the first node; an output part configured to output a voltage of a first power source or a voltage of the third input terminal to an output terminal in response to voltages applied to the first node and the second node; and a bidirectional driving part configured to be connected between the first input terminal and a fourth input terminal and the input part and to receive a first control signal or a second control signal, and when the first control signal is supplied, the first input terminal may receive a scan start signal or an output signal of a previous stage, the second input terminal may receive one of a first clock signal and a second clock signal, the third input terminal may receive the other of the first clock signal and the second clock signal, and when the second control signal is supplied, the fourth input terminal may receive a scan start signal or an output signal of a next stage, and the output part may output a voltage of the first power source when the first clock signal and the second clock signal are low levels.

According to some example embodiments, the input part may comprise a first transistor located between the first input terminal and the first node and including a gate electrode connected to the second input terminal; a second transistor located between the first node and the first power source and including a gate electrode connected to the third input terminal; and a third transistor located in series with the second transistor between the first node and the first power source and including a gate electrode connected to the second node.

According to some example embodiments, the output part may comprise a fourth transistor located between the first power source and the output terminal and including a gate electrode connected to the second node; a fifth transistor connected between the output terminal and the third input terminal and including a gate electrode connected to the first node; a first capacitor connected between the first node and the output terminal; and a second capacitor connected between the second node and the first power source.

According to some example embodiments, the driving part may comprise a sixth transistor located between the second node and the second input terminal and including a gate electrode connected to the first node; and a seventh transistor located between the second node and a second power source set to have a lower voltage than that of the first power source and including a gate electrode connected to the second input terminal.

According to some example embodiments, the bidirectional driving part may comprise an eighth transistor located between the first input terminal and the driving part and turned on when the first control signal is supplied; and a ninth transistor located between the fourth input terminal and the driving part and turned on when the second control signal is supplied.

According to some example embodiments, a period of the first clock signal and a period of the second clock signal may be the same, and a phase of the first clock signal and a phase of the second clock signal may not overlap each other.

According to some example embodiments, the period of the first clock signal and the period of the second clock signal may be 2 horizontal periods (2H), and the first clock signal having a low level pulse and the second clock signal having the low level pulse may be supplied to different horizontal periods, respectively.

According to some example embodiments, the scan start signal may be supplied to overlap the first clock signal or the second clock signal.

According to some example embodiments, the output part may output a voltage of the third input terminal when one of the first clock signal and the second clock signal is a high level and the other thereof is a low level.

According to some example embodiments, the second input terminal may receive the second clock signal, the third input terminal may receive the first clock signal, and the output part may output the first clock signal having the low level pulse as a scan signal when the first clock signal is the low level and the second clock signal is the high level.

Aspects of some example embodiments of the present invention include a display device including: a display part configured to comprise pixels defined by data lines and scan lines; a data driver configured to supply a data signal to the data lines; a scan driver configured to sequentially supply a scan signal to the scan lines based on a first clock signal, a second clock signal, and a scan start signal; and a timing controller configured to supply the scan start signal, the first clock signal, and the second clock signal to the scan driver so that the scan signal is sequentially supplied in a first direction or a second direction based on a position of a sensing scan line that is a pixel row to be sensed, wherein the timing controller may mask the first clock signal and the second clock signal so that supply of the scan signal is stopped in a next scan line of the sensing scan line after a sensing period in which the sensing scan line is selected.

According to some example embodiments, the scan driver may comprise a plurality of stages connected to each of the scan lines, the timing controller may supply the scan start signal to a first stage among the stages when the sensing scan line is located before a preset reference sensing scan line, supply the scan start signal to a second stage among the stages when the sensing scan line is located after the preset reference sensing scan line, and supply the scan start signal to one of the first stage and the second stage when the sensing scan line is located at the preset reference sensing scan line.

According to some example embodiments, the plurality of stages may comprise stages from a first stage to an n-th (n is a natural number greater than or equal to 2) stage, the first stage may be the above first stage, and the second stage may be the above n-th stage.

According to some example embodiments, a phase of the first clock signal and a phase of the second clock signal may not overlap each other, and before the sensing period, a period of the first clock signal and a period of the second clock signal may be the same.

According to some example embodiments, before the sensing period, the period of the first clock signal and the period of the second clock signal may be 2 horizontal periods (2H), and before the sensing period, the first clock signal of a low level and the second clock signal of a low level may be respectively supplied in different horizontal periods.

According to some example embodiments, a time during which the low level of the first clock signal or the second clock signal may be maintained is longer in the sensing period than in a period before the sensing period.

According to some example embodiments, the scan start signal may be supplied to overlap the first clock signal or the second clock signal.

According to some example embodiments, the timing controller may mask the first clock signal and the second clock signal by changing the first clock signal and the second clock signal from a high level voltage to a low level voltage.

According to some example embodiments, within the same horizontal period after the sensing period, one of the first clock signal and the second clock signal may be first changed from the high level voltage to the low level voltage, and after the clock signal is changed from the high level voltage to the low level voltage, the other of the first clock signal and the second clock signal may be changed from the high level voltage to the low level voltage.

According to some example embodiments, when the sensing scan line is an i-th (i is a natural number) scan line, the next scan line may be an (i+1)-th scan line or an (i+2)-th scan line.

Further details and characteristics of other example embodiments are illustrated and described in the detailed description and drawings.

As described above, the example embodiments of the present invention may include a scan driver and a display device that may reduce a time required for sensing by masking clock signals after a sensing period.

In addition, the example embodiments of the present invention may include a scan driver and a display device that may reduce power consumption by preventing or reducing instances of scan signals being unnecessarily supplied to each of scan lines after a scan line corresponding to a pixel row to be sensed.

The characteristics of example embodiments of the present invention are not limited by what is illustrated in the above, and more various effects are comprised in the present specification.

DETAILED DESCRIPTION

Figure 1:
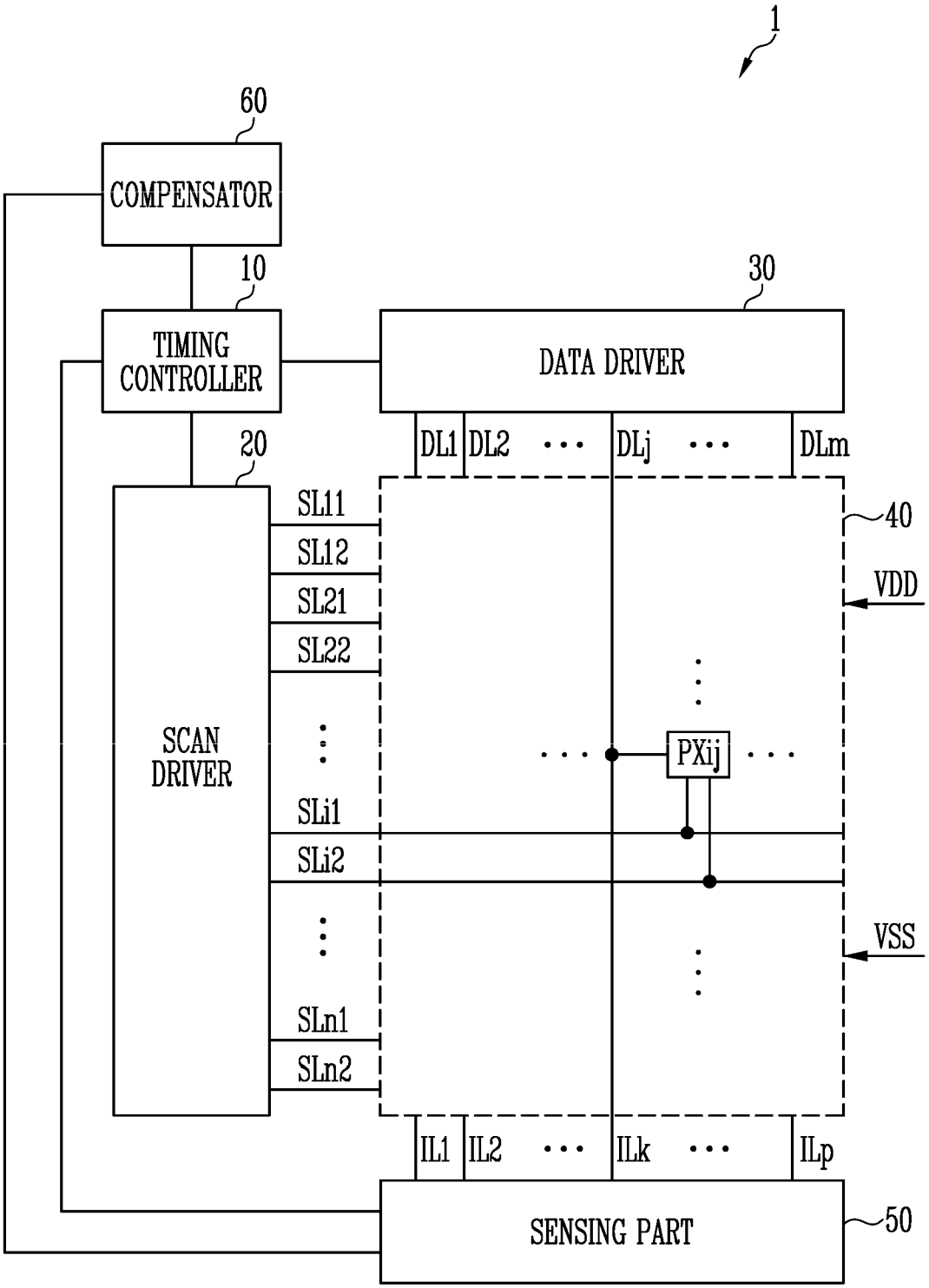
FIG. 1 illustrates a schematic view of a display device according to some example embodiments of the present invention.

Further details and characteristics of some example embodiments according to the present invention, and implementation methods thereof will be clarified through following embodiments described with reference to the accompanying drawings. The present invention may, however, be embodied in different forms and should not be construed as limited to the embodiments set forth herein. Rather, these example embodiments are provided so that this disclosure will be more thorough and more complete, and will more fully convey the scope of the present invention to those skilled in the art, and further, embodiments according to the present invention are only defined by scope of appended claims and their equivalents.

In adding reference numerals to elements of each drawing, like reference numerals may designate like elements throughout the specification. In describing the embodiments of the present invention, a detailed description of pertinent known constructions or functions may be omitted if it is deemed to make the gist of the present invention unnecessarily vague.

It will be further understood that, although the terms first, second, A, B, (a), (b), and the like may be used herein to describe elements of the present invention. These terms are only used in order to distinguish any element from other elements, and a feature, a sequence, an order, a number, or the like of the corresponding element is not limited by these terms. It is to be understood that when one element is referred to as being "connected or coupled" to another element, it may be directly connected or coupled to another component, but the other element may be interposed between respective elements, or respective elements may be connected or coupled by the other element. Meanwhile, singular forms are to comprise plural forms unless the context clearly indicates otherwise.

FIG. 1 illustrates a schematic view of a display device according to some example embodiments of the present invention.

Referring to FIG. 1, a display device 1 according to some example embodiments may comprise a timing controller 10, a scan driver 20, a data driver 30, a display part 40, a sensing part 50, and a compensator 60.

The timing controller 10 may receive various grayscale values (or grayscale data) and control signals for each image frame from an external processor. The timing controller 10 may render the grayscale values to correspond to a specification of the display device 1. For example, the external processor may provide a red grayscale value, a green grayscale value, and a blue grayscale value for each unit dot. However, for example, when the display part 40 has a pentile structure, adjacent unit dots share pixels, so that the pixels may not correspond one-to-one to respective grayscale values, and rendering of the grayscale values is necessary. When the pixels corresponds one-to-one to respective grayscale values, it may be unnecessary to render the grayscale values. The rendered or unrendered grayscale values may be provided to the data driver 30. Meanwhile, the timing controller 10 may provide control signals suitable for respective specifications to the scan driver 20 and the data driver 30 for frame display. Meanwhile, the timing controller 10 may provide control signals suitable for a specification to the sensing part 50 to command a sensing operation.

The scan driver 20 may receive clock signals, a scan start signal, and the like from the timing controller 10, and may generate first scan signals to be provided to first scan lines SL11, SL21, SLi1, and SLn1 and and second scan signals to be provided to second scan lines SL12, SL22, SLi2, and SLn2 based on the clock signals, the scan signal, and the like. n may be a natural number, and i may be a natural number less than or equal to n.

The scan driver 20 may sequentially supply first scan signals having a pulse of a turn-on level to the first scan lines SL11, SL21, SLi1, and SLn1. In addition, the scan driver 20 may sequentially supply second scan signals having a pulse of a turn-on level to the second scan lines SL12, SL22, SLi2, and SLn2. In this case, pixels PXij are selected in units of horizontal lines.

The scan driver 20 may sequentially supply the first scan signals and the second scan signals in a first direction, and sequentially supply the first scan signals and the second scan signals in a second direction.

Here, the first direction may mean, for example, that the scan signal is sequentially supplied from a first scan line to an n-th scan line. This first direction may be referred to as a forward direction.

Here, the second direction may mean, for example, that the scan signal is sequentially supplied from the n-th scan line to the first scan line. This second direction may be referred to as a reverse direction.

Here, the first scan line may mean the first scan line SL11 and the second scan line SL12, the second scan line may mean the first scan line SL21 and the second scan line SL22, and the i-th scan line may mean the first scan line SLi1 and the second scan line SLi2, and the n-th scan line may mean the first scan line SLn1 and the second scan line SLn2.

The above-described first direction and second direction are only examples for describing the present embodiments, but are not limited thereto, and the first direction and the second direction may be opposite to those described above.

Meanwhile, whether a direction in which the scan signals are sequentially supplied is the first direction or the second direction may be determined according to a position of a scan line to be sensed in a sensing period to be described later.

According to some example embodiments, the scan driver 20 may comprise a first scan driver connected to the first scan lines SL11, SL21, SLi1, and SLn1 and a second scan driver connected to the second scan lines SL12, SL22, SLi2, and SLn2. Each of the first scan driver and the second scan driver may comprise stages configured in a form of a shift register. Each of the first scan driver and the second scan driver may generate scan signals in a method of sequentially transmitting a scan start signal having a turn-on level pulse to a next stage according to control of clock signals.

In some example embodiments, the first scan signals and the second scan signals may be the same. In this case, the first scan line and the second scan line connected to each pixel PXij may be connected to the same node. In this case, the scan driver 20 is not divided into the first scan driver and the second scan driver, and may be configured as a single scan driver.

The data driver 30 may generate data voltages to be provided to the data lines DL1, DL2, DLj, and DLm by using grayscale values and control signals to be synchronized with the scan signal supplied from the scan driver 20.

For example, the data driver 30 may sample grayscale values by using a clock signal, and apply data voltages corresponding to the grayscale values to the data lines DL1, DL2, DLj, and DLm in units of pixel rows. m may be a natural number, and j may be a natural number less than or equal to m.

The display part 40 may comprise the pixels PXij. The pixels PXij may be defined by the data lines and the scan lines. That is, each pixel PXij may be connected to a data line, a scan line, and a sensing line that correspond thereto.

The pixels PXij are selected, when the scan signal is supplied, to charge a voltage corresponding to the data signal, and generate light having a predetermined luminance while supplying a driving current corresponding to the charged voltage to a light emitting diode.

Each of the pixels PXij may be implemented to have various circuit structures. As described below with reference to FIG. 2A and FIG. 2B, for example, each of the pixels PXij may be implemented to have a 3T1C structure including a first transistor, a second transistor, a third transistor, and a capacitor.

The sensing part 50 may receive a control signal from the timing controller 10 to receive a sensing signal through each of sensing lines IL1, IL2, ILk, and ILp. The sensing part 50 may be connected to the pixels PXij through the sensing lines IL1, IL2, ILk, and ILp.

For example, during a sensing period, the scan driver 20 sequentially supplies the scan signal, the pixels PXij connected to the scan lines are selected in units of horizontal lines, and the data driver 30 is synchronized with the scan signals to provide the sensing data signal (or sensing data voltage) for sensing the sensing signal to the data lines DL1, DL2, DLj, and DLm. Then, a sensing current (or sensing voltage) is generated from the selected pixels PXij. In this case, the sensing part 50 may receive a sensing signal corresponding to the sensing current (or sensing voltage) from the sensing lines IL1, IL2, ILk, and ILp. p may be a natural number, and may be the same as m described above. In addition, k may be a natural number smaller than p, and may be the same as j described above.

Here, the sensing period may mean, for example, a blank period between frames and a predetermined period after the display device 1 is turned off.

Meanwhile, because the sensing part 50 generates a predetermined sensing current (or sensing voltage) in the pixels PXij selected to sense the sensing signal, the light emitting diodes comprised in each of the selected pixels PXij emit light with a predetermined luminance. In this case, when the pixels PXij are sequentially selected in units of horizontal lines in the same sense as the display period and the sensing current (or sensing voltage) is sensed, it is easily viewed by a user that the pixels PXij emit light with a luminance (e.g., a set or predetermined luminance). Thus, in order to prevent or reduce such issues, the pixels PXij to sense the sensing current (or sensing voltage) may be arbitrarily determined by the timing controller 10. That is, the sensing scan line, which is a row of pixels to be sensed, may be randomly determined.

For example, the timing controller 10 may randomly determine a sensing scan line among n scan lines in the sensing period, and repeat the above-described process n times until n scanning lines are determined once as the sensing scan line in the sensing period, and store information on a position of the sensing scan line in a memory.

Meanwhile, even when the sensing scan line is randomly determined, the scan driver 20 may still supply the scan signal sequentially by starting from the first scan line (or n-th scan line). In this case, when the scan signal is always sequentially supplied by starting from the first scan line or the n-th scan line regardless of the position of the sensing scan line, a time required for sensing may unnecessarily increase. Therefore, in order to prevent or reduce such issues, the timing controller 10 may supply a scan start signal to the scan driver 20 so that the scan signal is sequentially supplied in the first direction or the second direction based on the position of the sensing scan line, and a first clock signal and a second clock signal may be additionally supplied to the scan driver 20. A further detailed description of this will be described later with reference to FIG. 6.

Meanwhile, when a sensing scan line is selected in a sensing period within one frame, another sensing scan line may be randomly determined only when the one frame ends and a next frame starts.

Generally, the scan signal is supplied to the n-th scan line when a scan signal supplying direction is the first direction or when the scan signal supplying direction to the first scan line, or the scan signal is supplied to the first scan line when the scan signal supplying direction is the second direction, thus one frame may end. In this case, when a scan signal is supplied to each of scan lines (hereinafter referred to as "next scan lines") after the sensing scan line, additional power consumption may be unnecessarily utilized, and a time required for sensing may unnecessarily increase.

To prevent or reduce such issues, the timing controller 10 may mask the first clock signal and the second clock signal so that the supply of the scan signal is stopped in the next scan line of the sensing scan line after the sensing period in which the sensing scan line is selected. A detailed description of this will be described in more detail later with respect to FIG. 7 to FIG. 11.

Here, when the sensing scan line is an i-th (i is a natural number) scan line, the next scan line may be an (i+1)-th scan line, or an (i+2)-th scan line.

The sensing part 50 may sense a sensing current (or sensing voltage), and output a sensing value thereof. Here, the sensing value (or sensing data) is a digital value and may mean a sensing current value of the sensing current (or a sensing voltage value of the sensing voltage).

Meanwhile, according to some example embodiments, the data driver 30 and the sensing part 50 may be separately configured. However, according to some example embodiments, the data driver 30 and the sensing part 50 may be integrally configured (e.g., incorporated within a single or unified component).

According to some example embodiments, the sensing part 50 may comprise sensing channels connected to the sensing lines IL1, IL2, ILk, and ILp. For example, the sensing lines IL1, IL2, ILk, and ILp and the sensing channels may correspond one-to-one.

The compensator 60 may calculate a current compensating value for each of the pixels PXij based on the sensing value of the sensing part 50.

For example, the compensator 60 may generate an output grayscale value by compensating for an input grayscale value inputted from the outside by using the sensing value outputted from the sensing part 50. Meanwhile, the input grayscale value may mean grayscale data for an image frame, which is grayscale data inputted from an external processor. In addition, the output grayscale value may mean grayscale data in which the input grayscale value is compensated by the compensator 60 to be inputted to the data driver 30.

The compensator 60 may comprise a look-up table. The look-up table may exist in a form of data or may exist in a physical form. The look-up table may previously store compensation amount data corresponding to a sensing value, a change amount of the sensing value, and the like before the display device 1 of FIG. 1 is shipped. According to some example embodiments, the display device 1 may further comprise a memory.

Hereinafter, further details of some example embodiments of the scan driver comprised in the display device 1 illustrated in FIG. 1 will be described, but for convenience, some of a plurality of stages will be illustrated.

Figure 2A:
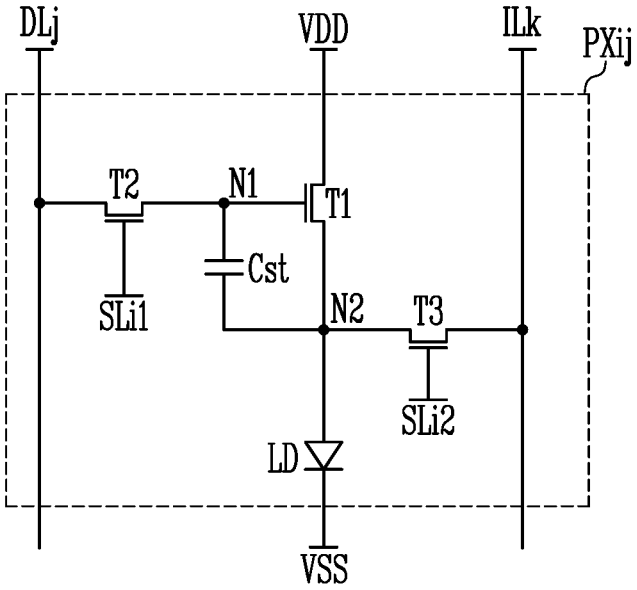
FIG. 2A and FIG. 2B illustrate circuit diagrams of example embodiments of a pixel comprised in the display device illustrated in FIG. 1.
Figure 2B:
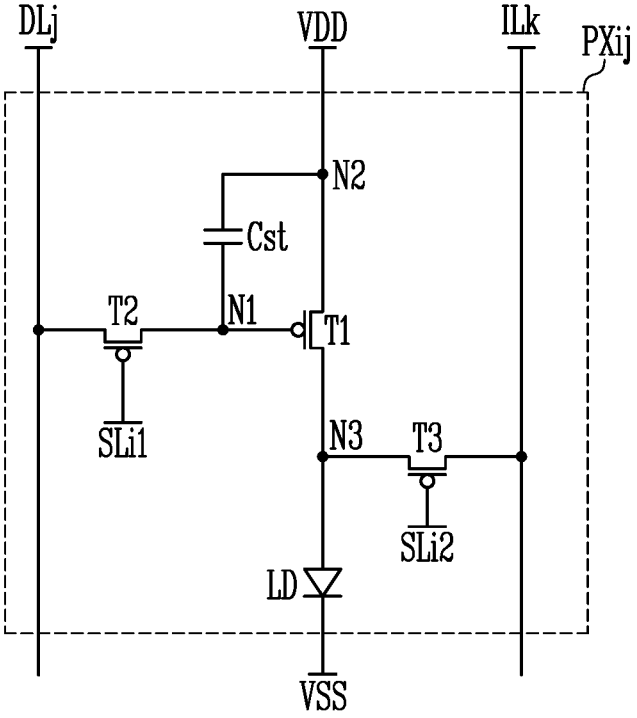

FIG. 2A and FIG. 2B illustrate circuit diagrams of example embodiments of a pixel comprised in the display device illustrated in FIG. 1.

Referring to FIG. 2A and FIG. 2B, the pixel PXij may comprise transistors T1, T2, and T3, a storage capacitor Cst, and a light emitting diode LD.

According to some example embodiments, the transistors T1, T2, and T3 may be configured as P-type transistors. According to some example embodiments, the transistors T1, T2, and T3 may be configured as N-type transistors. According to some example embodiments, the transistors T1, T2, and T3 may be configured as a combination of N-type transistors and P-type transistors. A P-type transistor refers to a transistor in which an amount of current that is conducted when a voltage difference between a gate terminal and a source terminal increases in a negative direction increases. An N-type transistor refers to a transistor in which an amount of current that is conducted when a voltage difference between a gate terminal and a source terminal increases in a positive direction increases. The transistor may have various kinds such as a thin film transistor (TFT), a field effect transistor (FET), and a bipolar junction transistor (BJT).

Referring to FIG. 2A, the transistors T1, T2, and T3 comprised in the pixel PXij shown in FIG. 2A may be N-type transistors.

The first transistor T1 may control the driving current described above based on the data signal. A gate electrode of the first transistor T1 may be connected to the first node N1, and a first electrode of the first transistor T1 may be connected to a first driving power source VDD (or a power source line of the first driving power source VDD), and a second electrode of the first transistor T1 may be connected to the second node N2. The first transistor T1 may be referred to as a driving transistor.

The second transistor T2 may be turned on when the first scan signal having a pulse of a turn-on level is supplied to the first scan line SLi1 to select the pixel PXij. A gate electrode of the second transistor T2 may connected to the first scan line SLi1, a first electrode of the second transistor T2 may be connected to the data line DLj, and a second electrode of the second transistor T2 may be connected to the first node N1. The second transistor T2 may be referred to as a scanning transistor.

The third transistor T3 is turned on when the second scan signal having a pulse of a turn-on level is supplied to the second scan line SLi2 to supply sensing signals to the sensing line ILk. A gate electrode of the third transistor T3 may be connected to the second scan line SLi2, a first electrode of the third transistor T3 may be connected to the second node N2, and a second electrode of the third transistor T3 may be connected to the sensing line ILk. The third transistor T3 may be referred to as a sensing transistor. Here, the sensing line ILk may be connected to an initializing power source.

The storage capacitor Cst may charge an amount of charge corresponding to a potential difference between a voltage of the first node N1 and a voltage of the second node N2. A first electrode of the storage capacitor Cst may be connected to the first node N1, and a second electrode of the storage capacitor Cst may be connected to the second node N2.

The light emitting diode LD is an element that emits light with a predetermined luminance. An anode of the light emitting diode LD may be connected to the second node N2, and a cathode of the light emitting diode LD may be connected to a second driving power source VSS (or a power source line of the second driving power source VSS).

Generally, a voltage of the first driving power source VDD may be higher than that of the second driving power source VSS. However, in a special situation such as preventing light emitting of the light emitting diode LD, the voltage of the second driving power source VSS may be set to be higher than that of the first driving power source VDD.

According to some example embodiments, during the display period, data voltages may be sequentially applied to the data line DLj in units of horizontal periods. A scan signal of a turn-on level (high level) may be applied to the first scan line SLi1 in a corresponding horizontal period. The scan signal of a turn-off level (low level) may be synchronized with the first scan line SLi1 to be applied to the second scan line SLi2. However, the present invention is not limited thereto, and the turn-off level scan signal may be always applied to the second scan line SLi2 during the display period.

For example, during the display period, when the turn-on level scan signal is applied to the first scan line SLi1 and the turn-off level scan signal is applied to the second scan line SLi2, the second transistor T2 may be turned on and the third transistor T3 may be turned off.

Meanwhile, according to some example embodiments, during the display period, data voltages may be sequentially applied to the data line DLj, and the scan signal of the turn-on level (high level) may be applied to the first scan line SLi1 in a corresponding horizontal period. It may be applied, and in synchronization with the first scan line SLi1, the turn-on level scan signal may be applied to the second scan line SLi2. Embodiments according to the present invention are not limited thereto, and the turn-on level scan signal may be always applied to the second scan line SLi2.

In addition, at any time during a period in which the second transistor T2 and the third transistor T3 are turned on, a data voltage may be applied to the first node N1, and an initializing voltage may applied to the second node N2.

In this case, a voltage corresponding to a difference between the data voltage and the initializing voltage is written in the storage capacitor Cst. That is, a voltage corresponding to a difference between the voltage of the first node N1 and the voltage of the second node N2 is written in the storage capacitor Cst.

In the pixel PXij, according to a voltage difference between the gate electrode of the first transistor T1 and the source electrode thereof (for example, the second electrode of the first transistor T1), an amount of driving current flowing through a driving path connecting the first driving power source VDD, the first transistor T1, and the second driving power source VSS is determined. Light emitting luminance of the light emitting diode LD may be determined according to the amount of driving current.

Thereafter, when a turn-off level (low level) scan signal is applied to the first scan line SLi1 and the second scan line SLi2, the second transistor T2 and the third transistor T3 may be turned off. Therefore, regardless of the voltage change of the data line DLj, the voltage difference between the gate electrode and the source electrode of the first transistor T1 may be maintained by the storage capacitor Cst, and the light emitting luminance of the light emitting diode LD may be maintained.

Meanwhile, during the sensing period, a sensing voltage may be applied to the data line DLj. In addition, when the the turn-on level scan signal is applied to the first scan line SLi1 and the second scan line SLi2 in synchronization with the sensing voltage, the second transistor T2 and the third transistor T3 may be turned on. Here, before the sensing voltage is applied to the data line DLj, the initializing voltage of the initializing power source may be applied to the second node N2 through the sensing line ILk.

Therefore, the sensing voltage is applied to the first node N1 of the pixel PXij, a voltage corresponding to a difference between the sensing voltage and the initializing voltage is written to the storage capacitor Cst, and the first transistor T1 is turned on. Accordingly, the sensing current flows through a sensing current path connecting the first driving power source VDD, the first transistor T1, the second node N2, and the third transistor T3. Here, the sensing current may comprise characteristic information of the first transistor T1.

Meanwhile, referring to FIG. 2*b*, the transistors T1, T2, and T3 comprised in the pixel PXij shown in FIG. 2B may be P-type transistors.

The first transistor T1 may control the driving current described above based on the data signal. The gate electrode of the first transistor T1 maybe connected to the first node N1, the first electrode of the first transistor T1 may be connected to the second node N2 connected to the first driving power source VDD, and the second electrode of the first transistor T1 may be connected to the third node N3. The first transistor T1 may be referred to as a driving transistor.

The second transistor T2 may be turned on when the first scan signal having the turn-on level pulse is supplied to the first scan line SLi1 to select the pixel PXij. The gate electrode of the second transistor T2 may be connected to the first scan line SLi1, the first electrode of the second transistor T2 may be connected to the data line DLj, and the second electrode of the second transistor T2 may be connected to the first node N1. The second transistor T2 may be referred to as a scanning transistor.

The third transistor T3 may be turned on when the second scan signal having the turn-on level pulse is supplied to the second scan line SLi2 to supply the sensing signals to the sensing line ILk. The gate electrode of the third transistor T3 may be connected to the second scan line SLi2, the first electrode of the third transistor T3 may be connected to the third node N3, and the second electrode of the third transistor T3 may be connected to the sensing line ILk. The third transistor T3 may be referred to as a sensing transistor. Here, the sensing line ILk may be connected to an initializing power source.

The storage capacitor Cst may be charged with an amount of charge corresponding to a potential difference between the voltage of the first node N1 and the voltage of the second node N2. The first electrode of the storage capacitor Cst may be connected to the first node N1, and the second electrode of the storage capacitor Cst may be connected to the second node N2.

The light emitting diode LD is an element that emits light with a predetermined luminance. An anode of the light emitting diode LD may be connected to the third node N3, and a cathode of the light emitting diode LD may be connected to the second driving power source VSS.

Generally, the voltage of the first driving power source VDD may be higher than that of the second driving power source VSS. However, in a special situation such as preventing light emitting of the light emitting diode LD, the voltage of the second driving power source VSS may be set to be higher than that of the first driving power source VDD.

During the display period, data voltages may be sequentially applied to the data line DLj in units of horizontal periods. The turn-on level (low level) scan signal may be applied to the first scan line SLi1 in a corresponding horizontal period. In addition, the turn-off level (high level) scan signal may be applied to the second scan line SLi2 in synchronization with the first scan line SLi1. According to some example embodiments, the turn-off level scan signal may be always applied to the second scan line SLi2 during the display period.

For example, during the display period, when the turn-on level scan signal is applied to the first scan line SLi1 and the turn-off level scan signal is applied to the second scan line SLi2, the second transistor T2 may be turned on and the third transistor T3 may be turned off.

In addition, the data voltage may be supplied to the data line DLj at any time during a period in which the second transistor T2 is turned on. The data voltage may be applied to the first node N1.

In this case, a voltage corresponding to a difference between the data voltage and the voltage of the first driving power source VDD is written to the storage capacitor Cst. That is, a voltage corresponding to a difference between the voltage of the first node N1 and the voltage of the second node N2 is written to the storage capacitor Cst.

In the pixel PXij, according to a voltage difference between the gate electrode and the source electrode (for example, the first electrode of the first transistor T1) of the first transistor T1, an amount of driving current flowing through a driving path connecting the first driving power source VDD, the first transistor T1, and the second driving power source VSS is determined. Light emitting luminance of the light emitting diode LD may be determined according to the amount of driving current.

Thereafter, when the turn-off level (high level) scan signal is applied to the first scan line SLi1 and the second scan line SLi2, the second transistor T2 and the third transistor T3 may be turned off. Therefore, regardless of the voltage change of the data line DLj, the voltage difference between the gate electrode and the source electrode of the first transistor T1 may be maintained by the storage capacitor Cst, and the light emitting luminance of the light emitting diode LD may be maintained.

Meanwhile, during the sensing period, a sensing voltage may be applied to the data line DLj. In addition, when the turn-on level scan signals are applied to the first scan line SLi1 and the second scan line SLi2 in synchronization with the sensing voltage, the second transistor T2 and the third transistor T3 may be turned on. Here, the voltage of the initializing power source may be applied to the third node N3 through the sensing line ILk before the sensing voltage is applied to the data line DLj.

Accordingly, the sensing voltage is applied to the first node N1 of the pixel PXij, and a voltage corresponding to a difference between the sensing voltage and the voltage of the first driving power source VDD is written to the storage capacitor Cst, and the first transistor T1 is turned on. Accordingly, the sensing current flows through a sensing current path connecting the first driving power source VDD, the second node N2, the first transistor T1, the third node N3, and the third transistor T3.

Hereinafter, for convenience of description, the pixels PXij of the present embodiments will be described with reference to those illustrated in FIG. 2B.

Figure 3:
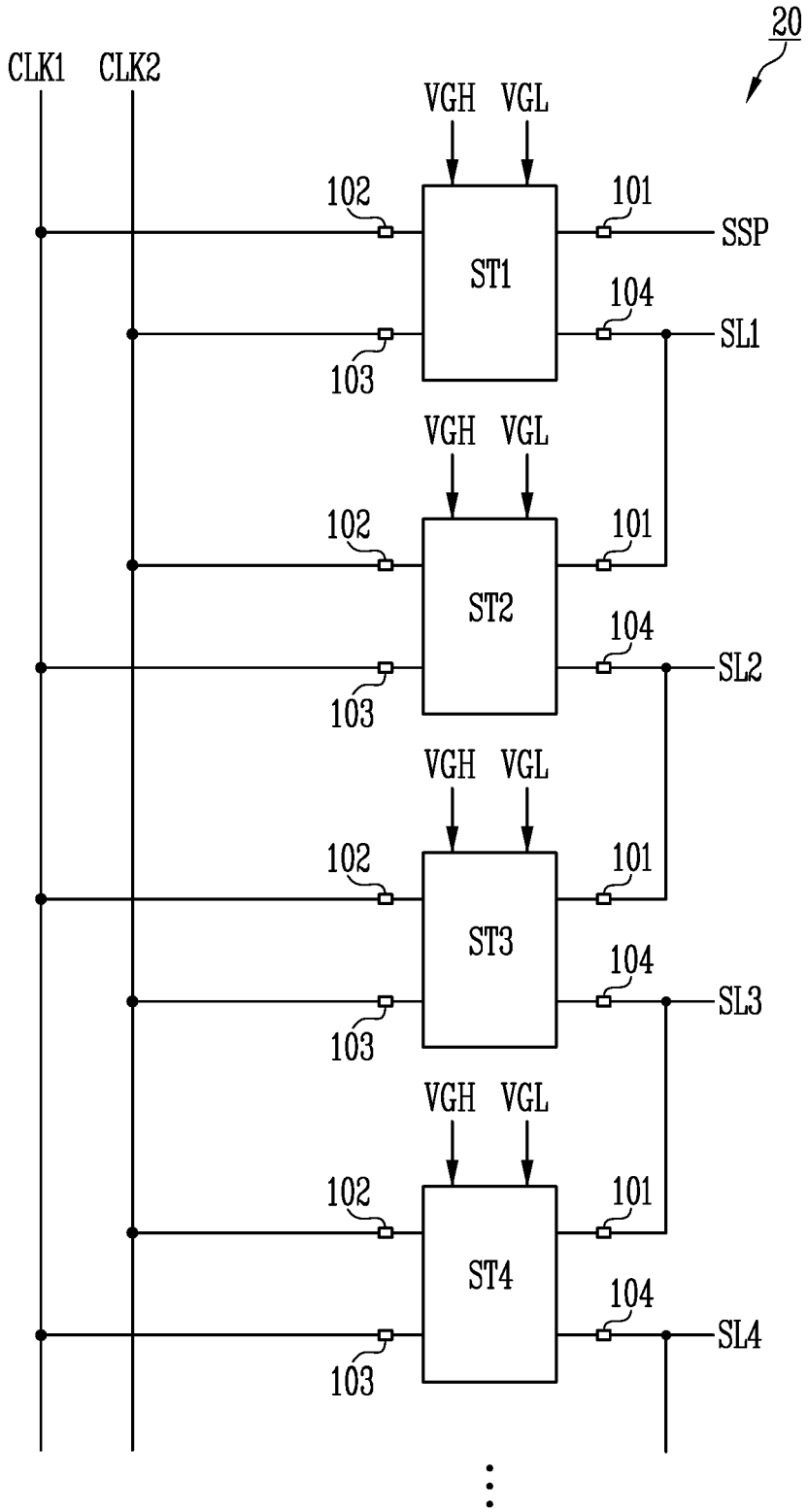
FIG. 3 illustrates a diagram of an example embodiment of a scan driver comprised in the display device illustrated in FIG. 1.

FIG. 3 illustrates a diagram of an embodiment of a scan driver comprised in the display device illustrated in FIG. 1.

In FIG. 3, four stages will be illustrated for convenience of description.

Referring to FIG. 3, the scan driver 20 according to some example embodiments of the present invention comprises a plurality of stages ST1 to ST4.

Each of the stages ST1 to ST4 may operate by receiving a voltage of a first power source VGH and a voltage of a second power source VGL, and is connected to one of scan lines SL1 to SL4, and is driven corresponding to signals CLK1 and CLK2. Here, the scan lines SL1 to SL4 may be the first scan lines SL11, SL21, SLi1, and SLn1 illustrated in FIG. 1, or may be the second scan lines SL12, SL22, SLi2, and SLn2 illustrated in FIG. 1. Hereinafter, for convenience of description, it is assumed that the scan lines SL1 to SL4 are the second scan lines SL12, SL22, SLi2, and SLn2.

A first stage ST1 of the stages ST1 to ST4 may mean a first stage, a second stage ST2 thereof may mean a second stage, and a third stage ST3 thereof may mean a third stage, and a fourth stage ST4 may mean a fourth stage. However, the present invention is not limited thereto.

Meanwhile, the stages ST1 to ST4 are configured of the same circuit.

Each of the stages ST1 to ST4 comprises a first input terminal 101, a second input terminal 102, a third input terminal 103, and an output terminal 104.

The first input terminal 101 of each of the stages ST1 to ST4 is supplied with an output signal (that is, a scan signal) or a scan start signal SSP of a previous stage. For example, the first input terminal 101 of the first stage ST1 that is the first stage among the stages ST1 to ST4, receives the scan start signal SSP, and the first input terminals 101 of the remaining stages ST2 to ST4 receive the output signals outputted from the output terminals 104 of their previous stages.

The second input terminals 102 of odd-numbered stages (for example, ST1 and ST3) receive the first clock signal CLK1, and the third input terminals 103 thereof receive the second clock signal CLK2. The second input terminals 102 of even-numbered stage (for example, ST2 and ST4) receive the second clock signal CLK2, and the third input terminals 103 thereof receive the first clock signal CLK1. However, the present invention is not limited thereto, and according to some example embodiments, the second input terminals 102 of the odd-numbered stage may receive the second clock signal CLK2, and the third input terminals 103 thereof may receive the first clock signal CLK1, and the second input terminals 102 of the even-numbered stage may receive the first clock signal CLK1, and the third input terminals 103 thereof may receive the second clock signal CLK2.

A period of the first clock signal CLK1 and a period of the second clock signal CLK2 are the same. In addition, a phase of the first clock signal CLK1 and a phase of the second clock signal CLK2 do not overlap each other. For example, when a period in which the scan signal is supplied to one scan line is 1 horizontal period 1H, the clock signals CLK1 and CLK2 respectively have a period of 2H, and are supplied to different horizontal periods, respectively. A detailed description of this will be described later with reference to FIG. 5.

Figure 4:
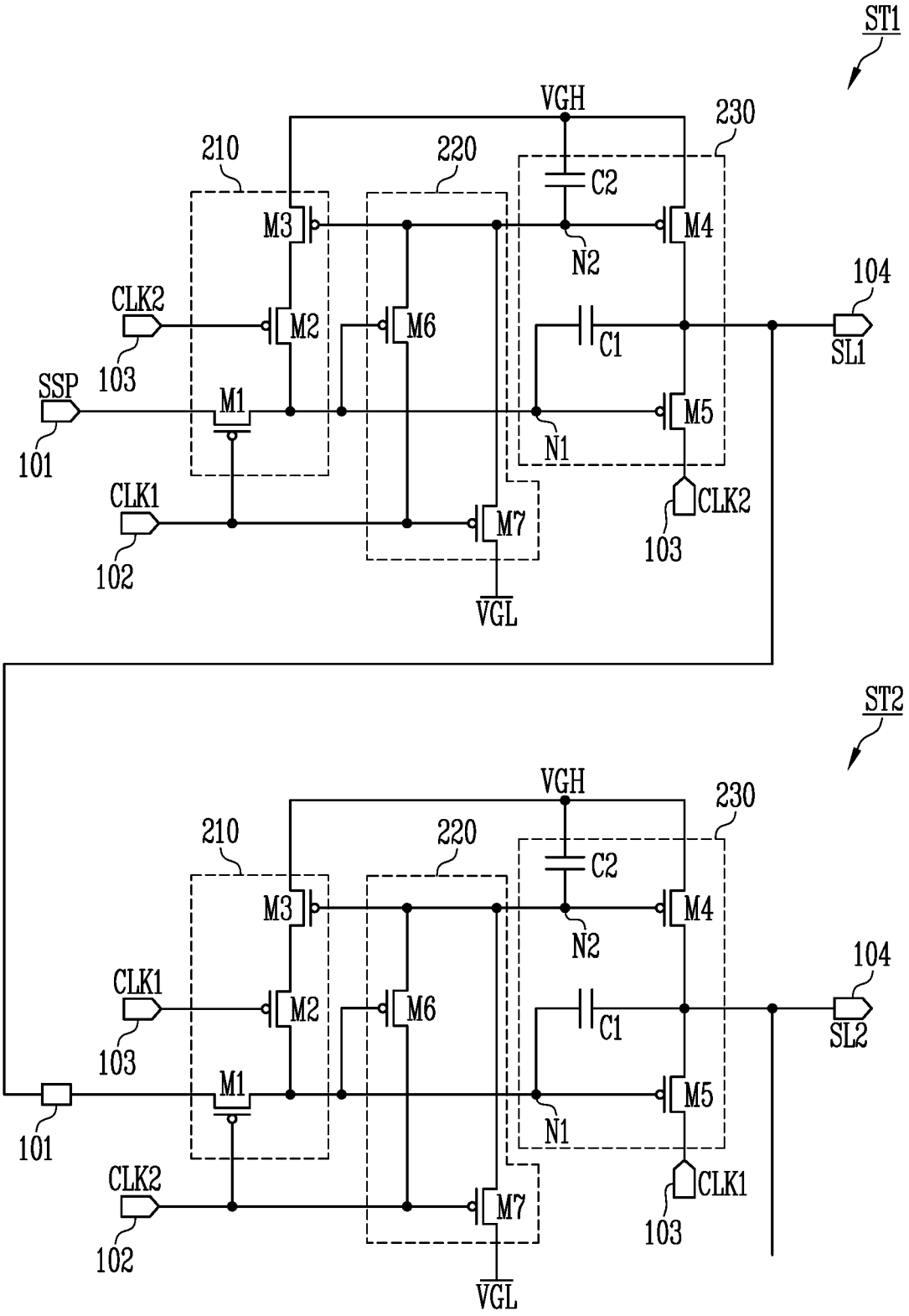
FIG. 4 illustrates a circuit diagram of an example embodiment of the stages illustrated in FIG. 3.

FIG. 4 illustrates a circuit diagram of an embodiment of the stages illustrated in FIG. 3.

In FIG. 4, the first stage ST1 and the second stage ST2 are illustrated for convenience of description. In addition, in FIG. 4, transistors are illustrated as formed of PMOS, but embodiments of the present invention are not limited thereto. For example, the transistors may be formed of NMOS. In addition, as described above, because the stages ST1 and ST2 are configured of the same circuit, hereinafter, the first stage ST1 will be mainly described, and in a case of the second stage ST2, except for the portion common with the first stage ST1, only unique features of the two stage ST2 will be described.

Referring to FIG. 4, the first stage ST1 according to some example embodiments of the present invention comprises an input part 210, a driving part 220, and an output part 230.

The input part 210 controls the voltage of the first node N1 in response to signals supplied to the first input terminal 101, the second input terminal 102, and the third input terminal 103. To this end, the input part 210 comprises first to third transistors M1, M2, and M3.

The first transistor M1 is located between the first input terminal 101 and the first node N1, and a gate electrode of the first transistor M1 is connected (or combined) to the second input terminal 102. The first transistor M1 controls connection between the first input terminal 101 and the first node N1 in response to a voltage supplied to the second input terminal 102.

The second transistor M2 and the third transistor M3 are connected in series between the first node N1 and the first power source VGH.

According to some example embodiments, the second transistor M2 is located between the first node N1 and the first power source VGH, and a gate electrode of the second transistor M2 is connected (or combined) to the third input terminal 103. The second transistor M2 controls connection between the third transistor M3 and the first node N1 in response to a voltage supplied to the third input terminal 103.

The third transistor M3 is located between the second transistor M2 and the first power source VGH, and a gate electrode of the third transistor M3 is connected (or combined) to the second node N2. The third transistor M3 controls connection of the second transistor M2 and the first power source VGH in response to a voltage of the second node N2.

The output part 230 controls a voltage supplied to the output terminal 104 in response to voltages applied to the first node N1 and the second node N2.

According to some example embodiments, when one of the first clock signal CLK1 and the second clock signal CLK2 is a high level and the other thereof is a low level, the output part 230 may output a voltage applied to the third input terminal 103.

According to some example embodiments, the second input terminal 102 of the output part 230 is supplied with the second clock signal CLK2, the third input terminal 103 of the output part 230 is supplied with the first clock signal CLK1, and when the first clock signal CLK1 is a low level and the second clock signal CLK2 is a high level, the output part 230 may output the first clock signal CLK1 having a low level pulse as a scan signal.

To this end, the output part 230 comprises a fourth transistor M4, a fifth transistor M5, a first capacitor C1, and a second capacitor C2.

The fourth transistor M4 is located between the first power source VGH and the output terminal 104, and a gate electrode of the fourth transistor M4 is connected (or combined) to the second node N2. The fourth transistor M4 controls connection between the first power source VGH and the output terminal 104 in response to a voltage applied to the second node N2. Here, a voltage of the first power source VGH is set to a gate-off voltage, for example, a high level voltage.

The fifth transistor M5 is located between the output terminal 104 and the third input terminal 103, and a gate electrode of the fifth transistor M5 is connected to the first node N1. The fifth transistor M5 controls connection between the output terminal 104 and the third input terminal 103 in response to the voltage applied to the first node N1.

The first capacitor C1 is connected between the first node N1 and the output terminal 104. The first capacitor C1 is charged with a voltage corresponding to turn-on or turn-off of the fifth transistor M5.

The second capacitor C2 is connected between the second node N2 and the first power source VGH. The second capacitor C2 is charged with the voltage applied to the second node N2.

The driving part 220 controls the voltage of the second node N2 in response to the voltages of the second input terminal 102 and the first node N1. To this end, the driving part 220 comprises a sixth transistor M6 and a seventh transistor M7.

The sixth transistor M6 is located between the second node N2 and the second input terminal 102, and a gate electrode of the sixth transistor M6 is connected to the first node N1. The sixth transistor M6 controls connection between the second node N2 and the second input terminal 102 in response to the voltage of the first node N1.

The seventh transistor M7 is located between the second node N2 and the second power source VGL, and a gate electrode of the seventh transistor M7 is connected to the second input terminal 102. The seventh transistor M7 controls connection of the second node N2 and the second power source VGL in response to the voltage of the second input terminal 102. Here, a voltage of the second power source VGL is set to a gate-on voltage, for example, a low level voltage.

Meanwhile, the first input terminal 101 of the second stage ST2 is connected (or combined) to the output terminal 104 of the first stage ST1.

Figure 5:
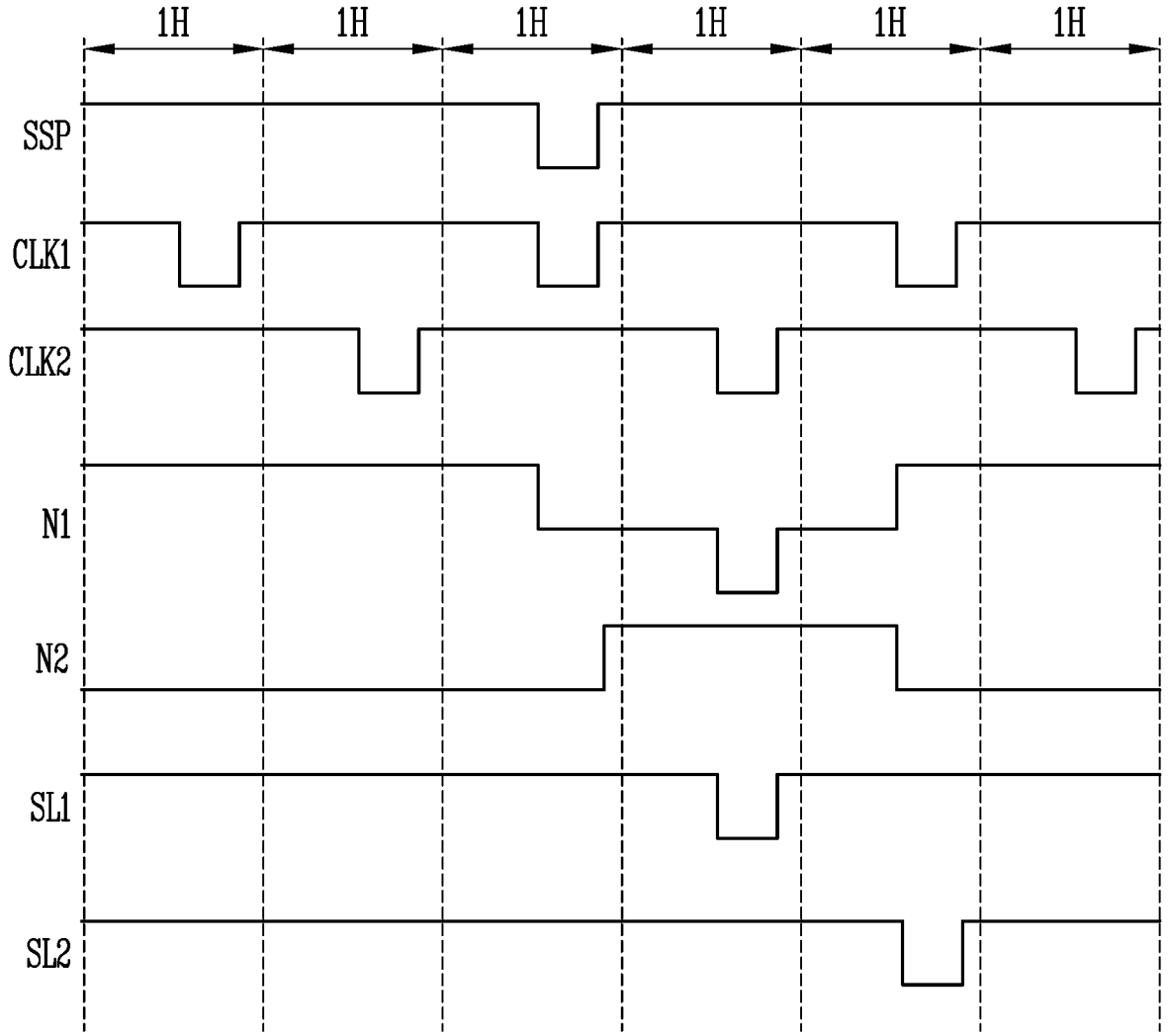
FIG. 5 illustrates a waveform diagram for explaining a driving method of the stage circuit shown in FIG. 4.

FIG. 5 illustrates a waveform diagram for explaining a driving method of the stage circuit shown in FIG. 4.

In FIG. 5, an operation process will be described by using the first stage ST1 for convenience of description.

Referring to FIG. 5, a period of the first clock signal CLK1 and a period of the second clock signal CLK2 are 2 horizontal periods 2H, and the first clock signal CLK1 having a low level pulse and the clock signal CLK2 having a low level pulse are supplied in different horizontal periods.

In addition, the scan start signal SSP is supplied to be synchronized with the clock signal CLK1 or CLK2 supplied to the second input terminal 102. For example, the scan start signal SSP may be supplied to overlap the first clock signal CLK1 or the second clock signal CLK2.

According to the operation process described in detail, the scan start signal SSP is first supplied to be synchronized with the first clock signal CLK1.

When the first clock signal CLK1 is supplied, the first transistor M1 and the seventh transistor M7 are turned on. When the first transistor M1 is turned on, the first input terminal 101 and the first node N1 are electrically connected. In this case, the first node N1 is set to a low voltage (or a low level voltage) by the scan start signal SSP supplied to the first input terminal 101. When the first node N1 is set to the low voltage, the fifth transistor M5 and the sixth transistor M6 are turned on.

When the fifth transistor M5 is turned on, the third input terminal 103 and the output terminal 104 are electrically connected. Here, a high voltage (or a high level voltage) is supplied to the third input terminal 103 (that is, the high level second clock signal CLK2 is supplied), and accordingly, a high voltage is outputted from the output terminal 104.

When the sixth transistor M6 is turned on, the second input terminal 102 and the second node N2 are electrically connected. Thus, the first clock signal CLK1 having a low level pulse supplied to the second input terminal 102 is supplied to the second node N2 (or, the first clock signal CLK1 at a low level is supplied to the second node N2).

When the seventh transistor M7 is turned on, the voltage of the second power source VGL is supplied to the second node N2. Here, the voltage of the second power source VGL is set to be the same (or similar) voltage as that of the first clock signal CLK1, and accordingly, the second node N2 is stably maintained at a low voltage.

When the low voltage is supplied to the second node N2, the third transistor M3 and the fourth transistor M4 are turned on. When the third transistor M3 is turned on, the first power source VGH and the second transistor M2 are electrically connected. Here, because the second transistor M2 is set to be in a turn-off state, even when the third transistor M3 is turned on, the low level voltage is stably maintained at the first node N1.

When the fourth transistor M4 is turned on, the voltage of the first power source VGH is supplied to the output terminal 104. Here, the voltage of the first power source VGH is set to be the same voltage as the high level voltage supplied to the third input terminal 103, and accordingly, the low level voltage is stably maintained at the output terminal 104.

Thereafter, the supply of the scan start signal SSP and the first clock signal CLK1 is stopped. When the supply of the first clock signal CLK1 is stopped, the first transistor M1 and the seventh transistor M7 are turned off. At this time, the fifth transistor M5 and the sixth transistor M6 maintain a turn-on state in response to a voltage stored in the first capacitor C1.

When the fifth transistor M5 maintains the turn-on state, the output terminal 104 and the third input terminal 103 maintain an electrical connection. Therefore, the output terminal 104 receives a high voltage from the third input terminal 103.

Meanwhile, because the sixth transistor M6 maintains the turn-on state, the second node N2 and the second input terminal 102 are electrically connected. Here, the voltage of the second input terminal 102 is set to be a high voltage in response to the stopping of the supply of the first clock signal CLK1, and accordingly, the second node N2 is also set to be the high voltage. When the high voltage is supplied to the second node N2, the fourth transistor M4 is turned off.

Thereafter, the second clock signal CLK2 having a low level pulse is supplied to the third input terminal 103. At this time, because the fifth transistor M5 is set to be the turn-on state, the second clock signal CLK2 supplied to the third input terminal 103 is supplied to the output terminal 104. In this case, the output terminal 104 outputs the second clock signal CLK2 as the scan signal to the scan line SL1.

After the scan signal is outputted to the scan line SL1, the low level first clock signal CLK1 is supplied. When the first clock signal CLK1 is supplied, the first transistor M1 and the seventh transistor M7 are turned on. When the first transistor M1 is turned on, the first input terminal 101 and the first node N1 are electrically connected. At this time, the high level scan start signal SSP is supplied to the first input terminal 101, and accordingly, it is set to be a high voltage. Accordingly, when the first transistor M1 is turned on, the high voltage is supplied to the first node N1, and accordingly, the fifth transistor M5 and the sixth transistor M6 are turned off.

When the seventh transistor M7 is turned on, the voltage of the second power source VGL is supplied to the second node N2, and accordingly, the third transistor M3 and the fourth transistor M4 are turned on. When the fourth transistor M4 is turned on, the voltage of the first power source VGH is supplied to the output terminal 104. Thereafter, the fourth transistor M4 and the third transistor M3 maintain a turn-on state corresponding to a voltage charged in the second capacitor C2, and accordingly, the output terminal 104 stably receives the voltage of the first power source VGH.

Meanwhile, when the second clock signal CLK2 is supplied, the second transistor M2 is turned on. At this time, because the third transistor M3 is set to be a turn-on state, the voltage of the first power source VGH is supplied to the first node N1. In this case, the fifth transistor M5 and the sixth transistor M6 are stably maintained to be a turn off state.

Meanwhile, the second stage ST2 receives the output signal (that is, the scan signal) of the first stage ST1 so at to be synchronized with the second clock signal CLK2. In this case, the second stage ST2 outputs the scan signal to the scan line SL2 so at to be synchronized with the first clock signal CLK1. Actually, the stages according to some example embodiments of the present invention sequentially output the scanning signal to the scanning lines while repeating the above-described process.

Figure 6:
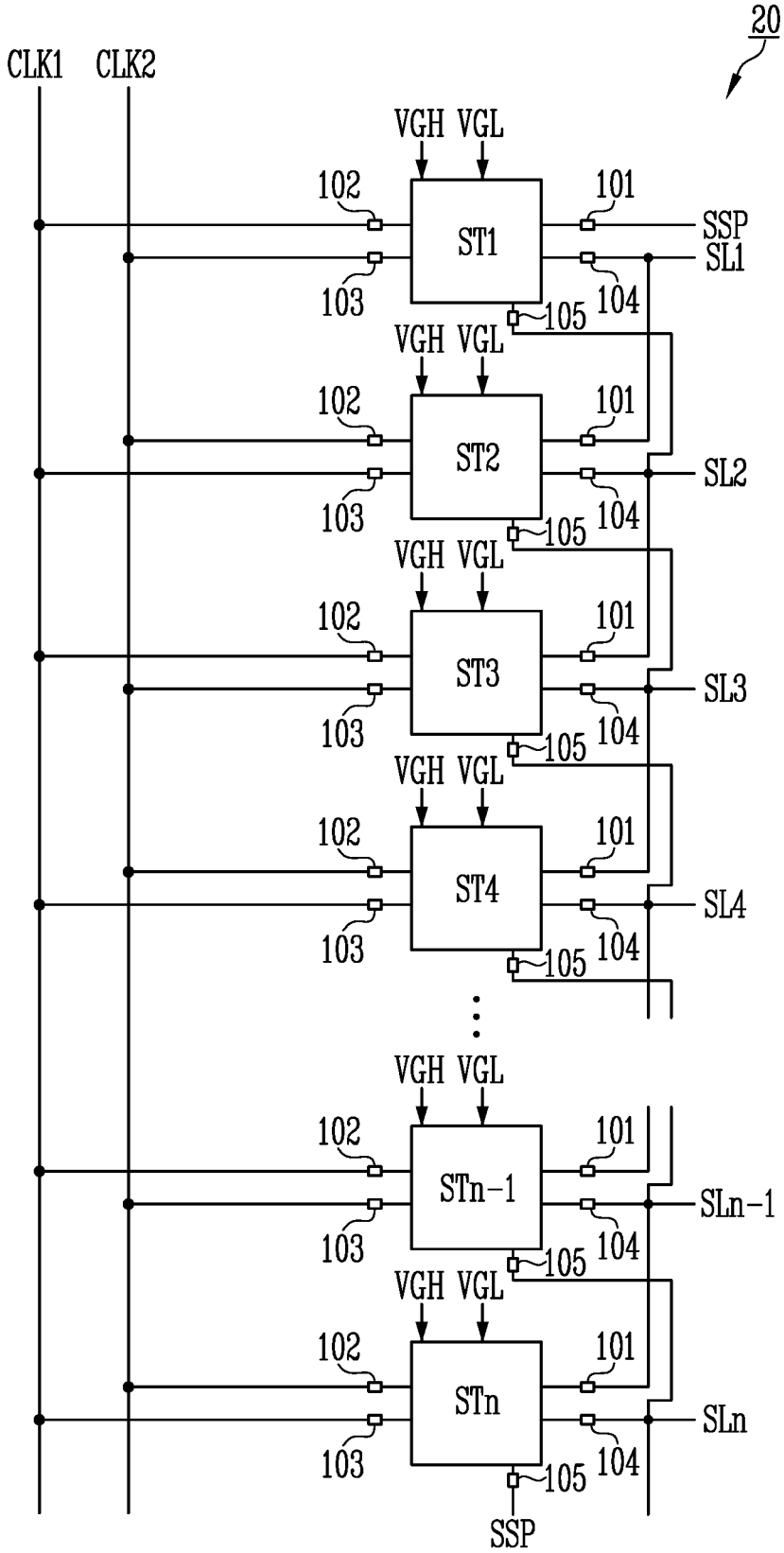
FIG. 6 illustrates a diagram of an example embodiment of a scan driver comprised in the display device illustrated in FIG. 1.

FIG. 6 illustrates a diagram of a scan driver comprised in the display device illustrated in FIG. 1 according to some example embodiments.

In FIG. 6, for convenience of description, the first stage ST1, the second stage ST2, the third stage ST3, the fourth stage ST4, the (n−1)-th stage STn-1, and the n-th stage STn will be illustrated. In addition, in FIG. 6, the same reference numerals are assigned to the same components as those illustrated in FIG. 3, and detailed descriptions thereof will be omitted.

Referring to FIG. 6, the scan driver 20 shown in FIG. 6 may comprise a plurality of stages ST1, ST2, ST3, ST4, STn-1, and STn connected to each of the scan lines, as in the scan driver 20 shown in FIG. 3. Here, the first stage ST1 may be a first stage of the display device 1 according to some example embodiments of the present invention, and the n-th stage STn may be an n-th stage thereof, which may be a last stage of display device 1 according to some example embodiments of the present invention.

However, each of the stages ST1, ST2, ST3, ST4, STn-1, and STn illustrated in FIG. 6 may further comprise a fourth input terminal 105, unlike the stages illustrated in FIG. 3.

The fourth input terminal 105 of each of the stages ST1, ST2, ST3, ST4, STn-1, and STn receives an output signal (that is, a scan signal) of a next stage or the scan start signal SSP.

For example, the fourth input terminal 105 of the first stage ST1 receives an output signal outputted from the output terminal 104 of the second stage ST2.

For another example, the fourth input terminal 105 of the (n−1)-th stage STn-1 receives an output signal outputted from the output terminal 104 of the n-th stage STn.

For another example, the fourth input terminal 105 of the n-th stage STn receives the scan start signal SSP.

Here, according to some example embodiments, when the scan start signal SSP is supplied to the first input terminal 101 of the first stage ST1, the scan signal may be sequentially supplied in the first direction (forward direction). In this case, the scan start signal SSP may not be supplied to the fourth input terminal 105 of the n-th stage STn.

Meanwhile, according to some example embodiments, when the scan start signal SSP is supplied to the fourth input terminal 105 of the n-th stage STn, the scan signal may be sequentially supplied in the second direction (reverse direction). In this case, the scan start signal SSP may not be supplied to the first input terminal 101 of the first stage ST1.

At this time, in order to minimize the time required for sensing, the timing controller 10 checks the position of the sensing scan line selected in the sensing period within one frame, and the position of the sensing scan line is compared with a preset reference sensing scan line, and according to the compared result, the scan start signal SSP may be supplied to the first input terminal 101 of the first stage ST1 or the scan start signal SSP may be supplied to the fourth input terminal 105 of the nth stage STn so that the scan signal is sequentially supplied in the first direction or the second direction.

For example, when the plurality of stages comprise stages from a first stage to an n-th (n is a natural number greater than or equal to 2) stage, the timing controller 10 may supply the scan start signal SSP to the first stage among n stages in a case in which the sensing scan line is located before a preset reference sensing scan line.

Meanwhile, when the sensing scan line is located after the preset reference sensing scan line, the timing controller 10 may supply the scan start signal SSP to the n-th stage among n stages.

When the sensing scan line is located at the preset reference sensing scan line, the timing controller 10 may supply the scan start signal SSP to one of the first stage and the n-th stage.

Here, the first stage may be, for example, the first stage ST1, and the n-th stage may be the n-th stage STn. However, the present invention is not limited thereto.

Here, when the number (n) of scan lines is even, the reference sensing scan line may be an (n/2)-th scan line. For example, when the number (n) of scan lines is 100, the reference sensing scan line may be a 50-th scan line. Meanwhile, when the number (n) of scan lines is odd, the reference sensing scan line may be an (N+½)-th scan line. For example, when the number (n) of scan lines is 101, the reference sensing scan line may be a 51-th scan line. However, the present invention is not limited thereto.

Meanwhile, contents other than the above-described description are the same as those shown in FIG. 3, so they will be omitted.

According to the above, because the scan signal may be supplied in both directions (first direction or second direction) according to the position of the scan line to be sensed, it is possible to minimize the time required for sensing.

Figure 7:
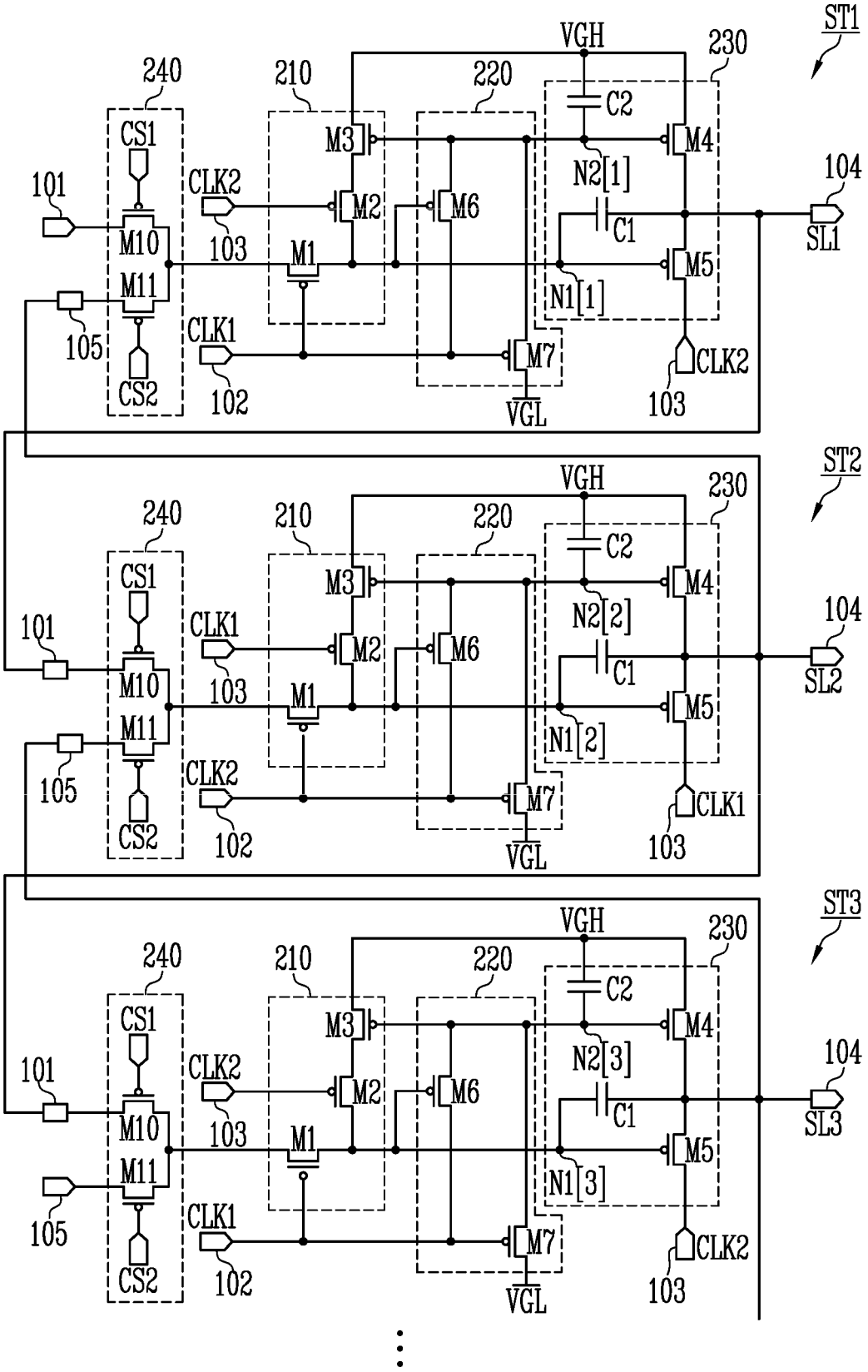
FIG. 7 illustrates a circuit diagram of an example embodiment of the stages illustrated in FIG. 6.

FIG. 7 illustrates a circuit diagram of an embodiment of the stages illustrated in FIG. 6.

In FIG. 7, for convenience of description, the first stage ST1, the second stage ST2, and the third stage ST3 will be illustrated. In addition, in FIG. 7, the same reference numerals are assigned to the same components as those illustrated in FIG. 4, and detailed descriptions thereof will be omitted.

Referring to FIG. 7, each of the stages ST1, ST2, and ST3 further comprises a bidirectional driving part 240.

The bidirectional driving part 240 operates so that the scan signal may be supplied in a first direction (a direction selected from the first scan line SL1 to the n-th scan line SLn) or a second direction (a direction selected from the n-th scan line SLn to the first scan line SL1). To this end, the bidirectional driving part 240 comprises a tenth transistor M10 and an eleventh transistor M11.

The tenth transistor M10 is connected between the first input terminal 101 and the input part 210. The tenth transistor M10 is turned on when a first control signal CS1 is supplied. Here, the first input terminal 101 receives the scan signal (or scan start signal SSP) of the previous stage. Meanwhile, the first control signal CS1 may be supplied by the timing controller 10.

The eleventh transistor M11 is connected between the fourth input terminal 105 and the input part 210. The eleventh transistor M11 is turned on when a second control signal CS2 is supplied. Here, the fourth input terminal 105 receives the scan signal (or scan start signal SSP) of the next stage. Meanwhile, the second control signal CS2 may be supplied by the timing controller 10.

In an operation process, when the first control signal CS1 is supplied to the bidirectional driving part 240 by the timing controller 10, the tenth transistor M10 is turned on. At this time, the second control signal CS2 is not supplied to the bidirectional driving part 240. When the tenth transistor M10 is turned on, each of the stages ST1, ST2, and ST3 is driven in response to the scan signal of the previous stage, and accordingly, the scan signal is sequentially outputted in the first direction.

Meanwhile, in a case of a sensing operation, when the sensing scan line is located before the reference sensing line or when is the same as the reference sensing line, the first control signal CS1 is supplied to the bidirectional driving part 240 by the timing controller 10 and the second control signal CS2 is not supplied to the bidirectional driving part 240, so that the scan signal may be sequentially outputted in the first direction.

For example, when the number of scan lines is 100 and the sensing scan line in the sensing period within one frame is determined as a 30-th scan line, because the 30-th scan line as the sensing scan line is located before the reference sensing scan line (for example, a 50-th scan line), the timing controller 10 may supply the scan start signal SSP to the first input terminal 101 of the first stage ST1 and the first control signal CS1 to the tenth transistor M10. When the scan start signal SSP is supplied to the first input terminal 101 of the first stage ST1 and the first control signal CS1 is supplied to the tenth transistor M10, the scan signal may be sequentially supplied to the scan lines in the first direction as described above.

Meanwhile, when the second control signal CS2 is supplied to the bidirectional driving part 240 by the timing controller 10, the eleventh transistor M11 is turned on. At this time, the first control signal CS1 is not supplied to the bidirectional driving part 240. When the eleventh transistor M11 is turned on, each of the stages ST1, ST2, and ST3 is driven in response to the scan signal of the next stage, and accordingly, the scan signal is outputted in the second direction. Because the other driving process is the same as that in the stage according to the embodiment of the present invention shown in FIG. 4, some repetitive detailed description thereof may be omitted.

Meanwhile, in the case of the sensing operation, when the sensing scan line is located after the reference sensing line or when it is the same as the reference sensing line, the second control signal CS2 is supplied to the bidirectional driving part 240 by the timing controller 10 and the first control signal CS1 is not supplied to the bidirectional driving part 240, so that the scan signal may be sequentially outputted in the second direction. A detailed description of this will be described with reference to FIG. 10.

Meanwhile, contents other than the above-described description are the same as those shown in FIG. 4, so they will be omitted.

Hereinafter, a specific method of masking clock signals will be described.

Figure 8:
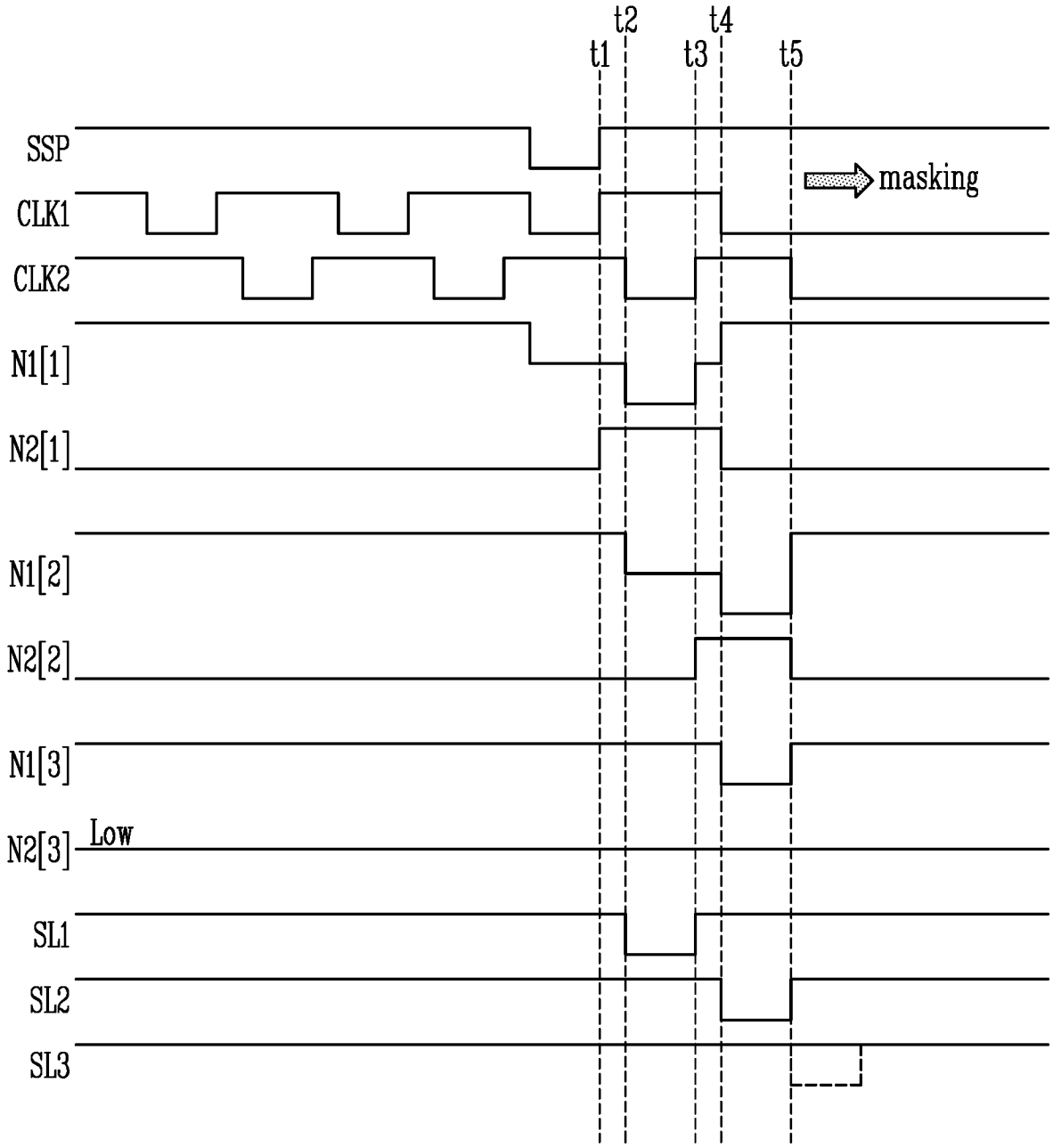
FIG. 8 is a circuit diagram illustrating example signals measured by the stage circuit illustrated in FIG. 7 when clock signals are masked at a specific time.

FIG. 8 is a circuit diagram illustrating example signals measured by the stage circuit illustrated in FIG. 7 when clock signals are masked at a specific time.

In FIG. 8, it is assumed that the scan line SL1 connected to the first stage ST1 or the scan line SL2 connected to the second stage ST2 is a sensing scan line for convenience of description.

In addition, from a first time point t1 to a third time point t3, the description of the signals measured at a first node N1[1] and a second node N2[1] of the first stage ST1 and at the output terminal 104 of the first stage ST1 and the description of the signals measured at a first node N1[2] and a second node N2[2] of the second stage ST2 and at the output terminal 104 of the second stage ST2 are the same as those described with reference to FIG. 5, so they are omitted.

Referring to FIG. 8, by changing the first clock signal CLK1 and the second clock signal CLK2 from the high level voltage to the low level voltage by the timing controller 10, the first clock signal CLK1 and the second clock signal CLK2 may be masked.

For example, within the same horizontal period after the sensing period, one (the first clock signal CLK1 in FIG. 8) of the first clock signal CLK1 and the second clock signal CLK2 is first changed from the high level voltage to the low level voltage. In addition, after one clock signal is changed from the high level voltage to the low level voltage, the other (the second clock signal CLK2 in FIG. 8) of the first clock signal CLK1 and the second clock signal CLK2 is changed from the high level voltage to the low level voltage.

Referring to FIG. 7 and FIG. 8, for example, at a fourth time point t4, the first clock signal CLK1 is changed from the high level voltage to the low level voltage, and the second clock signal CLK2 is maintained at the high level voltage.

At this time, the first transistor M1 and the seventh transistor M7 of the first stage ST1 are turned on. When the first transistor M1 of the first stage ST1 is turned on, the first node N1[1] of the first stage ST1 is connected to the first input terminal 101 of the first stage ST1, and because the scan start signal SSP supplied to the first input terminal 101 of the first stage ST1 is the high level voltage at the fourth time t4, the voltage of the first node N1[1] of the first stage ST1 is also changed to the high level voltage, and the fifth transistor M5 of the first stage ST1 is turned off.

When the seventh transistor M7 of the first stage ST1 is turned on, the second power source VGL and the second node N2[1] of the first stage ST1 are connected, and because the voltage of the second node N2[1] of the first stage ST1 is changed to the low level voltage, the third transistor M3 and the fourth transistor M4 of the first stage ST1 are turned on.

Meanwhile, at the fourth time point t4, the second clock signal CLK2 is maintained at the high level voltage, and the voltage of the first node N1[1] of the first stage ST1 is also the high level voltage, so the second transistor M2 and the sixth transistor M6 of the first stage ST1 are turned off.

Accordingly, at the fourth time point t4, the output terminal 104 of the first stage ST1 outputs the high level scan signal.

Meanwhile, at the fourth time point t4, although the first transistor M1 and the seventh transistor M7 of the second stage ST2 are turned off, because the first node N1[2] of the second stage ST2 is maintained at the low level voltage, the fifth transistor M5 of the second stage ST2 is turned on, and the third input terminal 103 of the second stage ST2 and the output terminal 104 of the second stage ST2 are connected.

In addition, because the voltages of the first clock signal CLK1 and the first node N1[2] of the second stage ST2 are the low level voltages, the second transistor M2 and the sixth transistor M6 of the second stage ST2 are turned on, and the first input terminal 101 of the second stage ST2 and the second node N2[2] of the second stage ST2 are connected, and the voltage of the second node N2[2] of the second stage ST2 is maintained at the high level voltage, and the third transistor M3 and the fourth transistor M4 of the second stage ST2 are turned off.

Accordingly, at the fourth time point t4, the voltage of the output terminal 104 of the second stage ST2 is changed from the high level voltage to the low level voltage.

Meanwhile, at a fifth time point t5, the first clock signal CLK1 is maintained at the low level voltage, and the second clock signal CLK2 is changed from the high level voltage to the low level voltage.

In this case, because the first transistor M1 of the second stage ST2 is turned on, the voltage of the first node N1[2] of the second stage ST2 may be the same as that of the signal supplied from the output terminal 104 of the first stage ST1. Accordingly, the voltage of the first node N1[2] of the second stage ST2 is changed from the low level voltage to the high level voltage. The fifth transistor M5 and the sixth transistor M6 of the second stage ST2 are turned off by the voltage of the first node N1[2] of the second stage ST2.

Meanwhile, when the second transistor M2 of the second stage ST2 is turned on and the second transistor M2 and the third transistor M3 of the second stage ST2 are turned on, by the first clock signal CLK1, the voltage of the first power source VGH is stably supplied to the first node N1[2] of the second stage ST2.

In addition, the seventh transistor M7 of the second stage ST2 is also turned on, and the second power source VGL and the second node N2[2] of the second stage ST2 are connected, and the voltage of the second node N2[2] of the second stage ST2 is changed from the high level voltage to the low level voltage. Further, the third transistor M3 and the fourth transistor M4 of the second stage ST2 are turned on by the voltage of the second node N2[2] of the second stage ST2.

Accordingly, at the fifth time point t5, the voltage of the output terminal 104 of the second stage ST2 is changed from the low level voltage to the high level voltage.

Meanwhile, at the fifth time point t5, the first transistor M1 and the seventh transistor M7 of the third stage ST3 are turned on. When the first transistor M1 of the third stage ST3 is turned on, the first node N1[3] of the third stage ST3 is connected to the output terminal 104 of the second stage ST2, and the voltage of the first node N1[3] of the third stage ST3 is changed from the low level voltage to the high level voltage. In addition, the fifth transistor M5 and the sixth transistor M6 of the third stage ST3 are turned off by the voltage of the first node N1[3] of the third stage ST3.

Meanwhile, at the fifth time point t5, the second transistor M2 of the third stage ST3 is turned on by the second clock signal CLK2, and when the second transistor M2 and the third transistor M3 of the third stage ST3 are turned on, the first power source VGH and the first node N1[3] of the third stage ST3 are connected, so that the high level voltage is stably supplied to the first node N1[3] of the third stage ST3.

In addition, the seventh transistor M7 of the third stage ST3 is also turned on, the second power source VGL and the second node N2[3] of the third stage ST3 are connected, and the voltage of the second node N2[2] of the second stage ST2 is maintained at the low level voltage. Further, the third transistor M3 and the fourth transistor M4 of the third stage ST3 are turned on by the voltage of the second node N2 [3] of the third stage ST3.

Accordingly, at the fifth time point t5, the voltage of the output terminal 104 of the third stage ST3 is maintained at the high level voltage.

Meanwhile, in FIG. 8, it is shown that a time point when the other (the second clock signal CLK2 in FIG. 8) of the first clock signal CLK1 and the second clock signal CLK2 is changed from the high level voltage to the low level voltage is the same as the fifth time point t5, but the present invention is not limited thereto, and the time point may be between the fourth time point t4 and the fifth time point t5.

When the time point when the other (the second clock signal CLK2 in FIG. 8) of the first clock signal CLK1 and the second clock signal CLK2 is changed from the high level voltage to the low level voltage is between the fourth time point t4 and the fifth time point t5, the scan signals may be supplied with the same pulse width in scan lines before the sensing scan line.

According to some example embodiments, after the fifth time point t5, the scan signal is not supplied from the scan lines connected to each of the third stage ST3 to the n-th stage STn. In addition, one frame may end immediately after the fifth time point.

According to the above, it may be possible to shorten unnecessary time for sensing by masking the clock signals after the sensing period.

In addition, power consumption may be reduced by preventing or reducing instances of unnecessary supply of scan signals to each of the scan lines after the sensing scan line.

Figure 9:
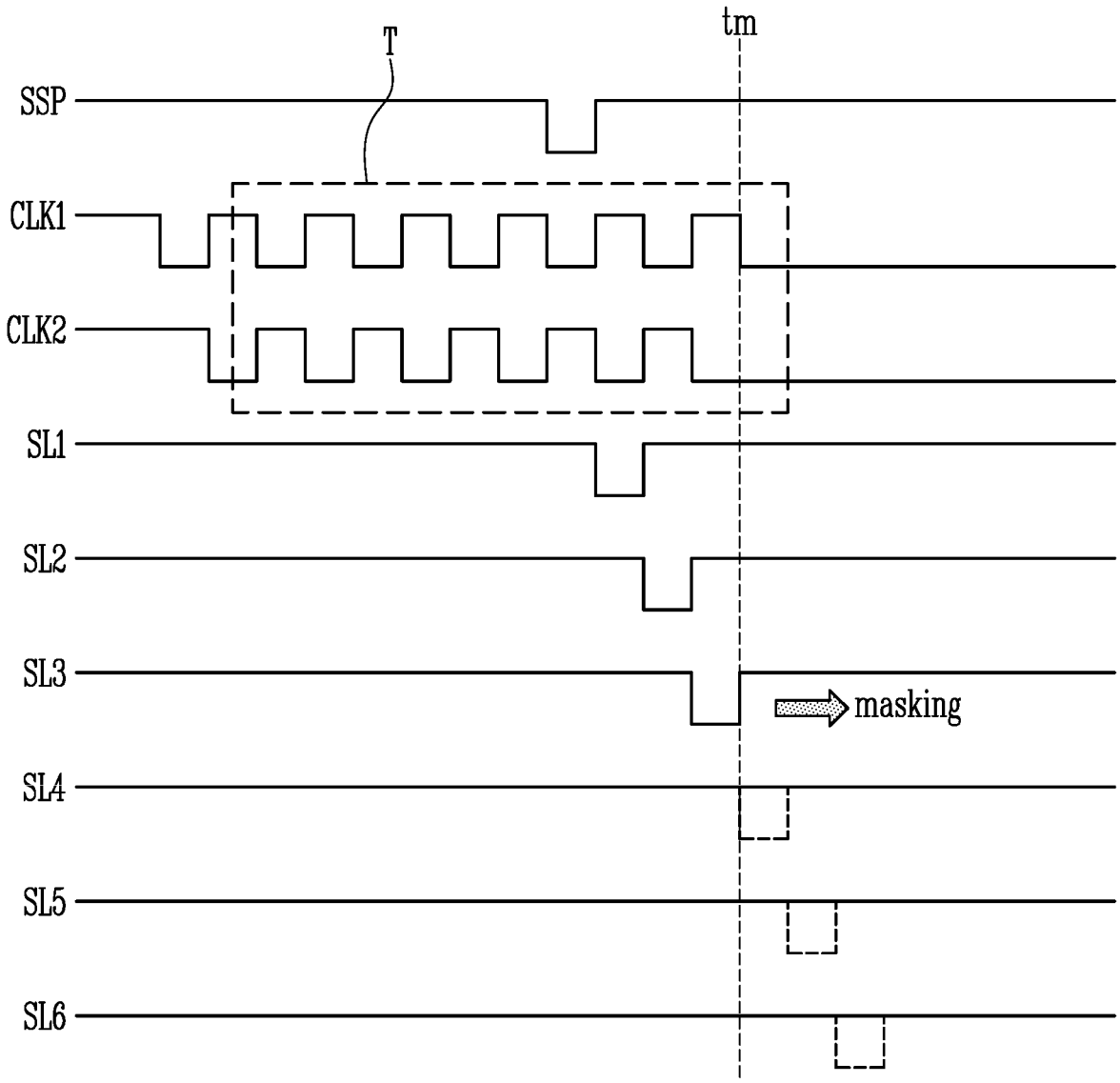
FIG. 9 is a waveform diagram illustrating example signals measured at output terminals of the stage circuits illustrated in FIG. 6 when clock signals are masked at a specific time.

FIG. 9 is a waveform diagram illustrating example signals measured at output terminals of the stage circuits illustrated in FIG. 6 when clock signals are masked at a specific time.

In FIG. 9, for convenience of description, the first scan line SL1 to the sixth scan line SL6 connected to each of the first stage ST1 to the sixth stage ST6 are illustrated, and it is assumed that the third scan line SL3 connected to the third stage ST3 is the sensing scan line, and the clock signals CLK1 and CLK2 are masked from the fifth stage ST5.

Referring to FIG. 1 and FIG. 9, in the clock signals CLK1 and CLK2 related to the masking timing in the sensing operation, the timing controller 10 sequentially counts the low level pulses of the respective clock signals CLK1 and CLK2 after supplying the scan start signal SSP to the scan driver 20, and when the total counting number matches the order (for example, the order of the i-th scan line is i) of the sensing scan line, the clock signals CLK1 and CLK2 may be masked from the next scan line of the sensing scan line.

Referring to FIG. 9, for example, after the scan start signal SSP is supplied, because the second clock signal CLK2 is first supplied in the form of the low level pulse, the timing controller 10 may count once (that is, the total number of counts 1) when the second clock signal CLK2 is supplied. Thereafter, because the first clock signal CLK1 is supplied in the form of the low level pulse, the timing controller 10 may count once (for example, the total number of counts 2)

when the first clock signal CLK1 is supplied. When the total counting number coincides with 3, which is the order of the third scan line SL3, which is the sensing scan line, the timing controller 10 may mask the clock signals CLK1 and CLK2 from after a certain time point tm.

Figure 10:
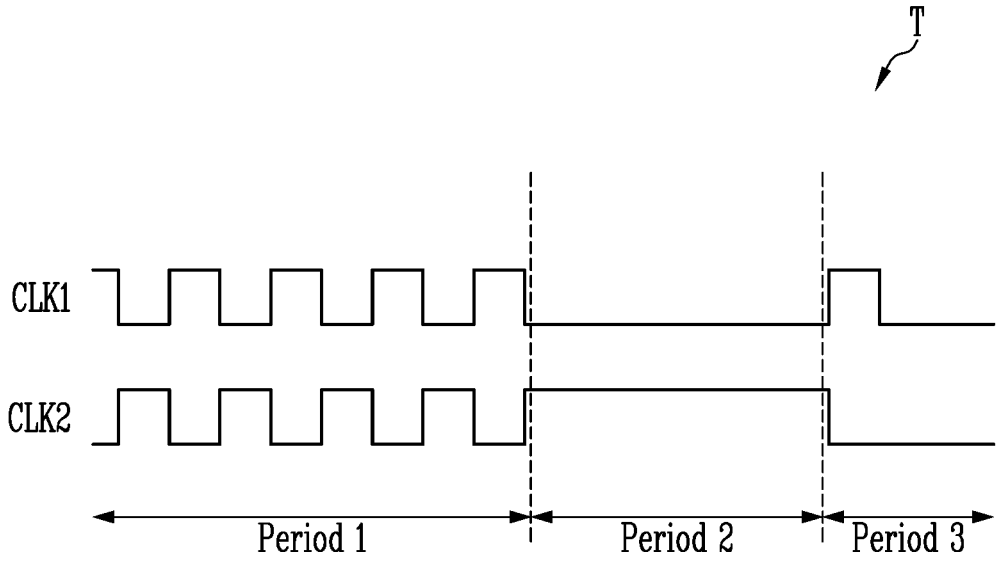
FIG. 10 illustrates an enlarged view of "T" shown in FIG. 9.

FIG. 10 illustrates an enlarged view of "T" shown in FIG. 9.

Referring to FIG. 10, one frame may comprise a first period (period 1) and a second period (period 2), and may also comprise a portion of a third period (period 3).

The first period (period 1) is a period for selecting the scan lines before the sensing scan line, and may be referred to as a dummy period. In this case, in order to select the sensing scan line faster, the first clock signal CLK1 and the second clock signal CLK2 may be adjusted by the timing controller 10 so that the period of the first clock signal CLK1 and the period of the second clock signal CLK2 in the first period (period 1) are shorter than the period of the first clock signal CLK1 and the period of the second clock signal CLK2 in the second period (period 2).

The second period (period 2) may be a sensing period. During the second period (period 2), the sensing scan line is selected, and the sensing operation may be performed. For example, one of the first clock signal CLK1 and the second clock signal CLK2 maintains the low level, and the other thereof maintains the high level, so that the sensing scan line may be selected. For example, the first clock signal CLK1 may maintain the low level, and the second clock signal CLK2 may maintain the high level. However, the present invention is not limited thereto.

Meanwhile, as shown in FIG. 10, a time during which the low level of each of the first clock signal CLK1 and the second clock signal CLK2 is maintained may be longer in the sensing period (for example, the second period (period 2)) than the period before the sensing period (for example, the first period (period 1)). For example, the time during which one of the first clock signal CLK1 and the second clock signal CLK2 maintains the low level and the time during which the other thereof maintains the high level may be longer and Each of the second clock signals CLK2 may be longer than that during which each of the first clock signal CLK1 and the second clock signal CLK2 is supplied in the first period (period 1). Therefore, it is possible to sufficiently secure the time required for sensing.

The third period (period 3) may be a period in which the clock signals CLK1 and CLK2 are masked.

In the third period (period 3), the timing controller 10, as described above with reference to FIG. 8, may mask the first clock signal and the second clock signal by changing the first clock signal and the second clock signal from the high level voltage to the low level voltage.

Figure 11:
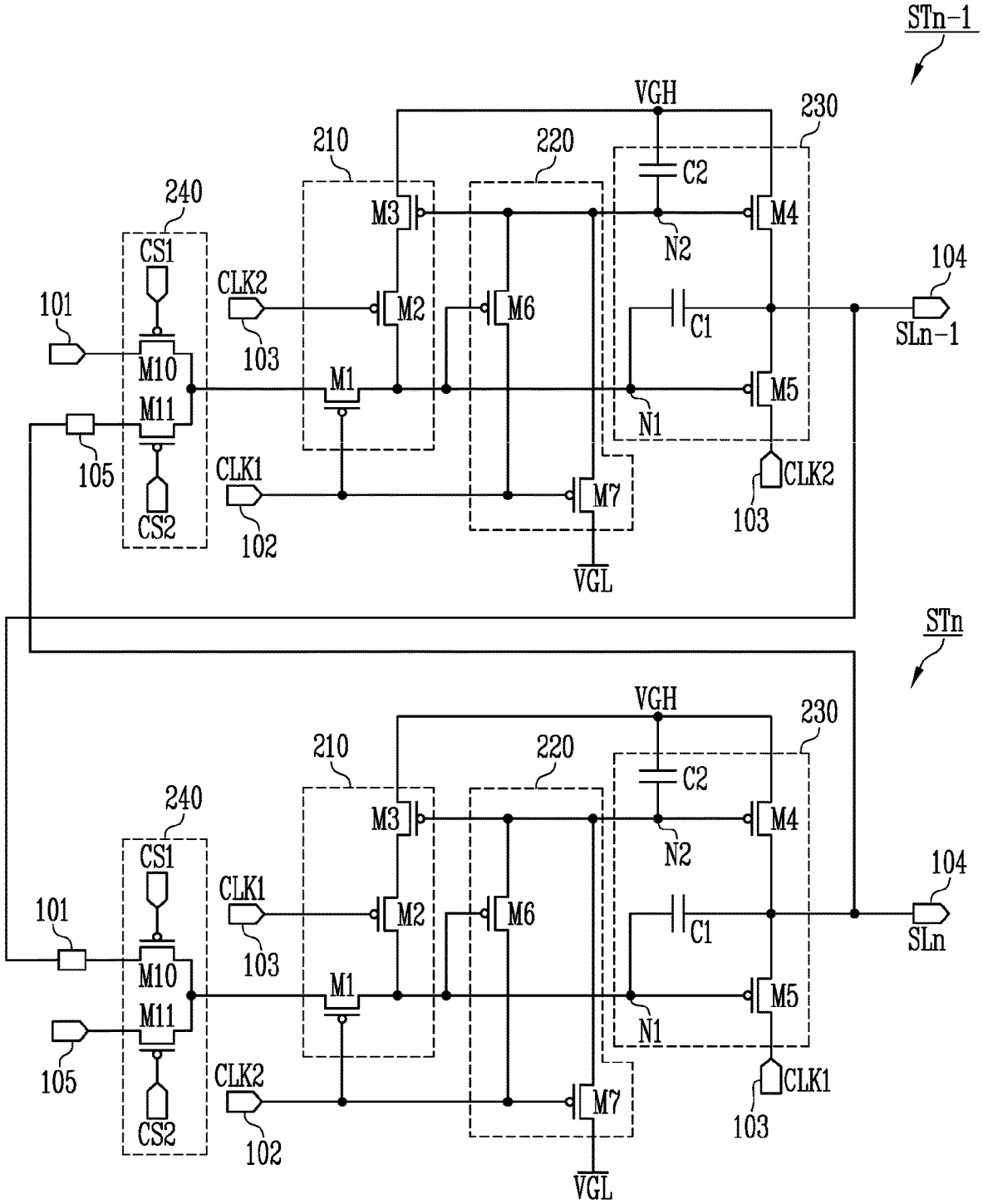
FIG. 11 illustrates a circuit diagram of an example embodiment of the stages illustrated in FIG. 6.

FIG. 11 illustrates a circuit diagram of an example embodiment of the stages illustrated in FIG. 6.

FIG. 11 illustrates an example of the stages STn-1 and STn, which are the (n−1)-th stage STn-1 and the n-th stage STn among the stages illustrated in FIG. 6. In addition, in FIG. 11, the same reference numerals are assigned to the same components as those illustrated in FIG. 7, and detailed descriptions thereof will be omitted.

The first input terminal 101 of the (n−1)-th stage STn-1 may be connected to an output terminal of the previous stage (for example, the (n−2)-th stage).

The fourth input terminal 105 of the (n−1)-th stage STn-1 may be connected to the output terminal 104 of the n-th stage STn.

The first input terminal 101 of the n-th stage STn may be connected to the output terminal 104 of the (n−1)-th stage STn-1.

Meanwhile, similarly to the above, when the scan signal is sequentially supplied in the second direction based on the position of the sensing scan line, the fourth input terminal 105 of the n-th stage STn may receive the scan start signal SSP.

For example, when the number of scan lines is 100 and the sensing scan line in the sensing period within one frame is determined as a 70-th scan line, the timing controller 10 may supply the scan start signal SSP to the fourth input terminal 105 of the n-th stage STn and supply the second control signal CS2 to the eleventh transistor M11. When the scan start signal SSP is supplied to the fourth input terminal 105 of the n-th stage STn, the scan signal may be sequentially supplied to the scan lines in the second direction as described above.

Meanwhile, when it is determined that the scan signal is sequentially supplied in the second direction, the timing controller 10 supplies the second control signal CS2 to the bidirectional driving part 240, the eleventh transistor M11 is turned on, the n-th stage STn is driven in response to the scan start signal SSP, and the (n−1)-th stage STn-1 is driven in response to the scan signal of the n-th stage STn. Accordingly, the scan signal is outputted in the second direction. Because the other driving processes are the same as those in the stages according to the embodiments of the present invention shown in FIG. 4 and FIG. 7, detailed descriptions thereof will be omitted.

Meanwhile, in the case of the sensing operation, when the sensing scan line is located after the reference sensing line or when it is the same as the reference sensing line, the second control signal CS2 is supplied to the bidirectional driving part 240 by the timing controller 10, so that the scan signal may be sequentially outputted in the second direction.

For example, when the number of the scan lines is 100 and the sensing scan line in the sensing period within one frame is determined as the 70-th scan line, the 70-th scan line, which is the sensing scan line, is located after the reference sensing scan line (for example, the 50-th scan line), so that the timing controller 10 may supply the scan start signal SSP to the fourth input terminal 105 of the n-th stage STn. When the scan start signal SSP is supplied to the fourth input terminal 105 of the n-th stage STn, the scan signal may be sequentially supplied to the scan lines in the second direction as described above. Because the other operation process is the same as described above, it will be omitted.

While aspects of some example embodiments of the present invention are described with reference to the attached drawings, those with ordinary skill in the technical field of the present invention will be understood that embodiments according to the present invention may be carried out in other specific forms without departing from the spirit and scope of embodiments according to the present disclosure as defined by the following claims and their equivalents. Accordingly, the above-described embodiments should be considered in descriptive sense only and not for purposes of limitation.

What is claimed is:

1. A scan driver comprising:

a plurality of stages, wherein each of the stages comprises an input part configured to control voltage of a first node in response to signals of a first input terminal, a second input terminal, and a third input terminal;

a driving part configured to control a voltage of a second node in response to voltages of the second input terminal and the first node;

an output part configured to output a voltage of a first power source or a voltage of the third input terminal to an output terminal in response to voltages applied to the first node and the second node; and a bidirectional driving part configured to be connected between the first input terminal and a fourth input terminal and the input part and to receive a first control signal or a second control signal, and wherein the first input terminal is configured to receive a scan start signal or an output signal of a previous stage when the first control signal is supplied, wherein the second input terminal is configured to receive one of a first clock signal and a second clock signal, wherein the third input terminal is configured to receive the other of the first clock signal and the second clock signal, and wherein the fourth input terminal is configured to receive a scan start signal or an output signal of a next stage when the second control signal is supplied, and wherein the output part is configured to output a voltage of the first power source when the first clock signal and the second clock signal are low levels.

2. The scan driver of claim 1, wherein the input part comprises a first transistor between the first input terminal and the first node and including a gate electrode connected to the second input terminal;

a second transistor between the first node and the first power source and including a gate electrode connected to the third input terminal; and a third transistor in series with the second transistor between the first node and the first power source and including a gate electrode connected to the second node.

3. The scan driver of claim 2, wherein the output part comprises a fourth transistor between the first power source and the output terminal and including a gate electrode connected to the second node;

a fifth transistor between the output terminal and the third input terminal and including a gate electrode connected to the first node;

a first capacitor between the first node and the output terminal; and a second capacitor between the second node and the first power source.

4. The scan driver of claim 3, wherein the driving part comprises a sixth transistor between the second node and the second input terminal and including a gate electrode connected to the first node; and a seventh transistor between the second node and a second power source set to have a lower voltage than that of the first power source and including a gate electrode connected to the second input terminal.

5. The scan driver of claim 4, wherein the bidirectional driving part comprises an eighth transistor between the first input terminal and the driving part and turned on when the first control signal is supplied; and a ninth transistor between the fourth input terminal and the driving part and turned on when the second control signal is supplied.

6. The scan driver of claim 1, wherein a period of the first clock signal and a period of the second clock signal are the same, and a phase of the first clock signal and a phase of the second clock signal do not overlap each other.

7. The scan driver of claim 6, wherein the period of the first clock signal and the period of the second clock signal are two horizontal periods (2H), and the first clock signal having a low level pulse and the second clock signal having the low level pulse are supplied to different horizontal periods, respectively.

8. The scan driver of claim 1, wherein the scan start signal is supplied to overlap the first clock signal or the second clock signal.

9. The scan driver of claim 1, wherein the output part is configured to output a voltage of the third input terminal in response to one of the first clock signal and the second clock signal being a high level and the other thereof being a low level.

10. The scan driver of claim 9, wherein the second input terminal is configured to receive the second clock signal, the third input terminal is configured to receive the first clock signal, and the output part is configured to output the first clock signal having the low level as a scan signal in response to the first clock signal being the low level and the second clock signal being the high level.

11. A display device comprising:

a display part comprising pixels defined by data lines and scan lines;

a data driver configured to supply a data signal to the data lines;

a scan driver configured to sequentially supply a scan signal to the scan lines based on a first clock signal, a second clock signal, and a scan start signal; and a timing controller configured to supply the scan start signal, the first clock signal, and the second clock signal to the scan driver so that the scan signal is sequentially supplied in a first direction or a second direction based on a position of a sensing scan line that is a pixel row to be sensed, wherein the timing controller masks the first clock signal and the second clock signal so that supply of the scan signal is stopped in a next scan line of the sensing scan line after a sensing period in which the sensing scan line is selected.

12. The display device of claim 11, wherein the scan driver comprises a plurality of stages connected to each of the scan lines, and the timing controller is configured to supply the scan start signal to a first stage among the stages in response to the sensing scan line being located before a preset reference sensing scan line, to supply the scan start signal to a second stage among the stages in response to the sensing scan line being located after the preset reference sensing scan line, and to supply the scan start signal to one of the first stage and the second stage in response to the sensing scan line being located at the preset reference sensing scan line.

13. The display device of claim 12, wherein the plurality of stages comprises stages from a first stage to an n-th (n is a natural number greater than or equal to 2) stage, the first stage is the above first stage, and the second stage is the above n-th stage.

14. The display device of claim 11, wherein a phase of the first clock signal and a phase of the second clock signal do not overlap each other, and before the sensing period, a period of the first clock signal and a period of the second clock signal are the same.

15. The display device of claim 14, wherein before the sensing period, the period of the first clock signal and the period of the second clock signal are 2 horizontal periods (2H), and before the sensing period, the first clock signal of a low level and the second clock signal of a low level are respectively supplied in different horizontal periods.

16. The display device of claim 15, wherein a time during which the low level of the first clock signal or the second clock signal is maintained is longer in the sensing period than in a period before the sensing period.

17. The display device of claim 11, wherein the scan start signal is supplied to overlap the first clock signal or the second clock signal.

18. The display device of claim 11, wherein the timing controller is configured to mask the first clock signal and the second clock signal by changing the first clock signal and the second clock signal from a high level voltage to a low level voltage.

19. The display device of claim 18, wherein within the same horizontal period after the sensing period, one of the first clock signal and the second clock signal is first changed from the high level voltage to the low level voltage, and after the clock signal is changed from the high level voltage to the low level voltage, the other of the first clock signal and the second clock signal is changed from the high level voltage to the low level voltage.

20. The display device of claim 11, wherein in response to the sensing scan line being an i-th (i is a natural number) scan line, the next scan line is an (i+1)-th scan line or an (i+2)-th scan line.

* * * * *